US012161922B2

(12) United States Patent
Wandler et al.

(10) Patent No.: US 12,161,922 B2
(45) **Date of Patent: *Dec. 10, 2024**

(54) GOLF SWING ANALYZER SYSTEM

(71) Applicant: BWR Innovations LLC, Fargo, ND (US)

(72) Inventors: Jeff A. Wandler, Fargo, ND (US); Joel A. Jorgenson, Fargo, ND (US); Thomas W. Nelson, Apple Valley, MN (US); Landon E. Lee, Dilworth, MN (US); Adam C. Jorgenson, Fargo, ND (US); Travis J. DeJong, Moorhead, MN (US); Thomas S. Wohl, West Fargo, ND (US)

(73) Assignee: BWR Innovations LLC, Fargo, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/446,620

(22) Filed: Aug. 9, 2023

(65) Prior Publication Data

US 2023/0381613 A1 Nov. 30, 2023

Related U.S. Application Data

(63) Continuation of application No. 17/351,680, filed on Jun. 18, 2021, now Pat. No. 11,724,165.

(51) Int. Cl.
*A63B 69/36* (2006.01)
*A63B 24/00* (2006.01)
(Continued)

(52) U.S. Cl.
CPC ..... *A63B 60/46* (2015.10); *A63B 24/0003* (2013.01); *A63B 69/3661* (2013.01);
(Continued)

(58) Field of Classification Search
CPC ..... A63B 60/46; A63B 69/36; A63B 69/3614; A63B 69/362; A63B 69/3632;
(Continued)

(56) References Cited

U.S. PATENT DOCUMENTS 4,615,526 A * 10/1986 Yasuda ..... A63B 69/36 273/456
10,363,470 B2 7/2019 Glenn
(Continued)

OTHER PUBLICATIONS

PCT International Search Report and Written Opinion for PCT/US21/46097; Nov. 22, 2021.

*Primary Examiner* — Lawrence S Galka
(74) *Attorney, Agent, or Firm* — Neustel Law Offices

(57) ABSTRACT

A golf swing analyzer system for analyzing a golfer's golf swing. An inertial measurement unit (IMU) may be used to capture data regarding the swing. The IMU may be oriented along a hosel-axis and a face-axis to reduce the complexity of calculations to determine the path of the swing. Two IMUs may be used to permit correction of captured data, different orientations of the IMUs to increase accuracy of captured data, and a doubling of the captured data. The IMU may include a magnetometer that cooperates with a magnet that is adapted to indicate the time at or near impact of the head of the golf club with the golf ball. An LED system provides visual information to a user regarding the swing while the swing is being made.

20 Claims, 18 Drawing Sheets

(51) Int. Cl.
*A63B 60/46* (2015.01)
*A63B 71/06* (2006.01)

(52) U.S. Cl.
CPC .. *A63B 71/0622* (2013.01); *A63B 2071/0647* (2013.01); *A63B 2220/44* (2013.01); *A63B 2220/833* (2013.01); *A63B 2220/89* (2013.01); *A63B 2225/20* (2013.01); *A63B 2225/74* (2020.08)

(58) Field of Classification Search
CPC ..... A63B 69/3661; A63B 2225/50; A63B 2220/16; A63B 2220/24; A63B 2220/30; A63B 2220/40; A63B 2220/44; A63B 2220/833; A63B 2071/0647; A63B 2071/0694; A63B 24/0003; A63B 2024/0028; A63B 2102/32; A63B 53/00; G06F 3/0346
See application file for complete search history.

(56) References Cited

U.S. PATENT DOCUMENTS

| | | | | |
|---|---|---|---|---|
| 2005/0215340 | A1 | 9/2005 | Stites | |
| 2011/0053698 | A1 | 3/2011 | Stites | |
| 2011/0305369 | A1 | 12/2011 | Bentley | |
| 2012/0046118 | A1* | 2/2012 | Nam | A63B 69/3614 473/220 |
| 2013/0203518 | A1 | 8/2013 | Hatton | |
| 2014/0200092 | A1 | 7/2014 | Parke | |
| 2016/0158598 | A1 | 6/2016 | Dolezel | |
| 2016/0166902 | A1 | 6/2016 | Day | |
| 2016/0303443 | A1 | 10/2016 | Boggs | |
| 2016/0310820 | A1 | 10/2016 | Kline | |
| 2017/0144022 | A1 | 5/2017 | Glenn | |
| 2017/0312571 | A1 | 11/2017 | Thornton | |
| 2018/0178096 | A1 | 6/2018 | Boggs | |
| 2020/0070019 | A1 | 3/2020 | Wallans | |

* cited by examiner

GOLF SWING ANALYZER SYSTEM

CROSS REFERENCE TO RELATED APPLICATIONS

The present application is a continuation of U.S. application Ser. No. 17/351,680 filed on Jun. 18, 2021 which issues as U.S. Pat. No. 11,724,165 on Aug. 15, 2023. Each of the aforementioned patent applications is herein incorporated by reference in their entirety.

STATEMENT REGARDING FEDERALLY SPONSORED RESEARCH OR DEVELOPMENT

Not applicable to this application.

BACKGROUND

The described example embodiments in general relate to a golf club motion analyzer for analyzing a user's swing of a golf club.

The most effective current method of analyzing the swing of a golf club is to use video cameras to capture images of the actual swing; however, the equipment to do video analysis is very expensive and not available to the average golfer. Other systems use inertial measurement units to measure the linear and rotation acceleration of the golf club to determine its position throughout the swing; however, determining the position of the golf club from the data collected requires complex mathematics. Golfers would benefit from a system that provides visual cues while swinging and collects data that is more directly related to the position of the club thereby requiring less complex mathematics to determine the position of the golf club throughout the swing.

SUMMARY

Some of the various embodiments of the present disclosure relate to a golf swing analyzer system that can analyze a golfer's golf swing. The golf swing analyzer system includes a golf club that has a motion capture system that captures data regarding the movements of the golf club. The motion capture system includes one or more inertial measurement units (IMU) that capture data regarding the movement of the golf club. The one or more IMUs may be oriented with respect to the head of the golf club to collect data along a hostel-axis and a face-axis of the golf club. Collecting data along the hosel-axis and the face-axis simplifies the mathematics required to determine the movement of the golf club.

When the motion capture system includes two IMUs, the first IMU may have a different orientation than the second IMU. Orienting the first IMU and the second IMU differently provides information for generating corrected data that is more accurate for determining the movement of the golf club. Using two IMUs also doubles the amount of data that can be collected by a single IMU. Further, the sampling times of the two IMUs may be offset to more accurately sample the movement of the golf club.

One or more of the IMUs may include a magnetometer. The magnetometer may cooperate with a magnet to detect the time at or near impact of the head of the golf club with a golf ball. The time at or near impact may be used to reference all other data collected regarding the movement of the golf club, so all collected data may be assessed with respect to the time at or near impact. The magnet may be adapted to be used with a mat.

The golf swing analyzer system may include devices, such as a server and/or computing devices, that have displays for visually presenting the data collected regarding the swing. The motion capture system, the server and/or the computing devices may perform calculations on the collected data to determine the velocity, the orientation and/or the path of travel of the head of the golf club. The presentation of collected and/or calculated data may indicate the time at or near impact.

The golf club may further include an LED system. The LED system may include at least two LEDs. The LEDs are arranged so that the light from the LEDs provides visual information to the user regarding the path of the swing and the orientation of the head of the golf club. The golf club with the LED system may be used with the mat to enhance the visual information provided to the user.

There has thus been outlined, rather broadly, some of the embodiments of the present disclosure in order that the detailed description thereof may be better understood, and in order that the present contribution to the art may be better appreciated. There are additional embodiments of that will be described hereinafter and that will form the subject matter of the claims appended hereto. In this respect, before explaining at least one embodiment in detail, it is to be understood that the various embodiments are not limited in its application to the details of construction or to the arrangements of the components set forth in the following description or illustrated in the drawings. Also, it is to be understood that the phraseology and terminology employed herein are for the purpose of the description and should not be regarded as limiting.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evidence to the contrary from the description, where elements in different figures use identical reference numbers, the elements are generally either identical or at least similar in function or purpose.

DETAILED DESCRIPTION

A. Overview

Figure 1:
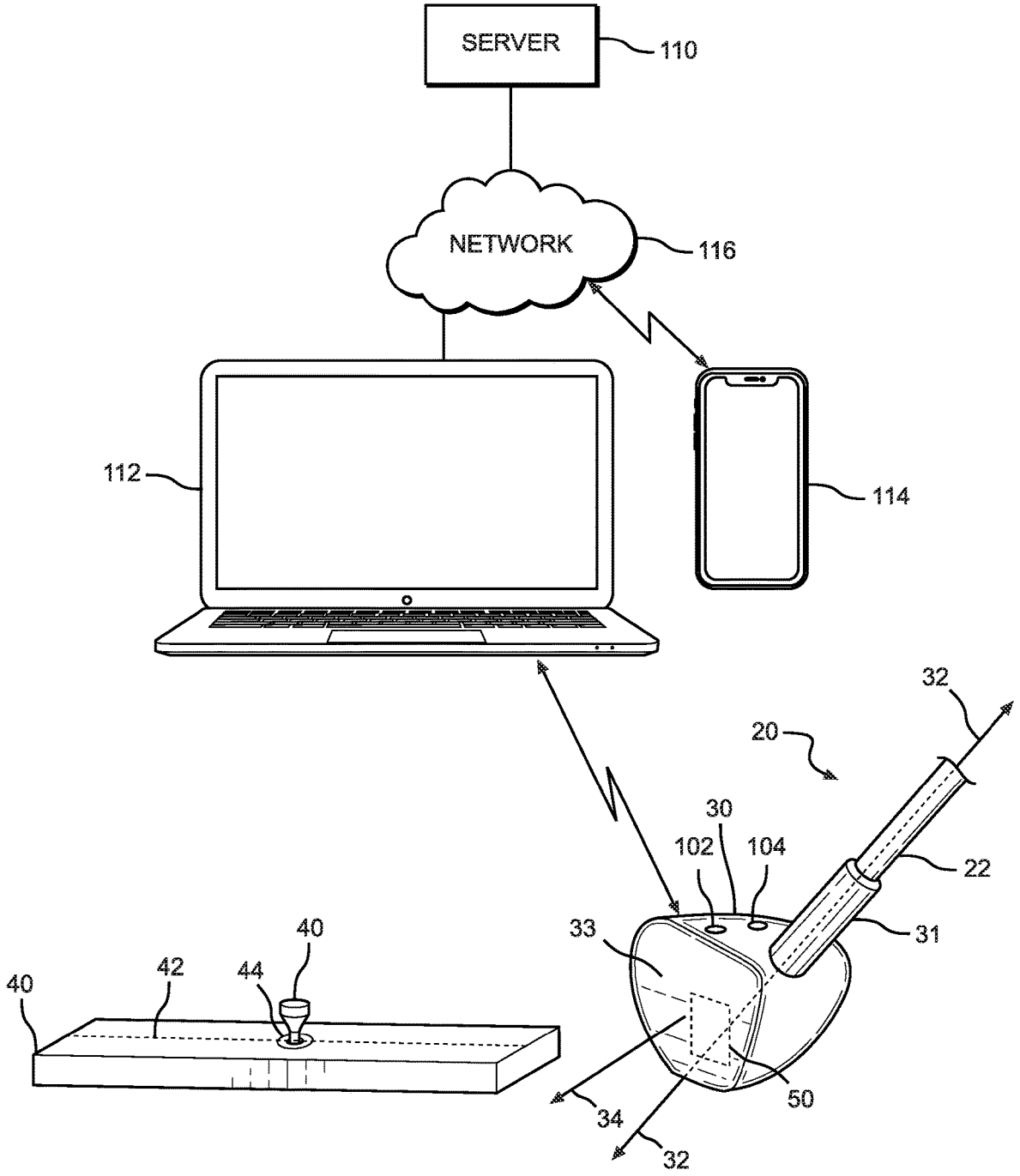
FIG. 1 is a diagram of a golf swing analyzer system in accordance with an example embodiment.
Figure 2:
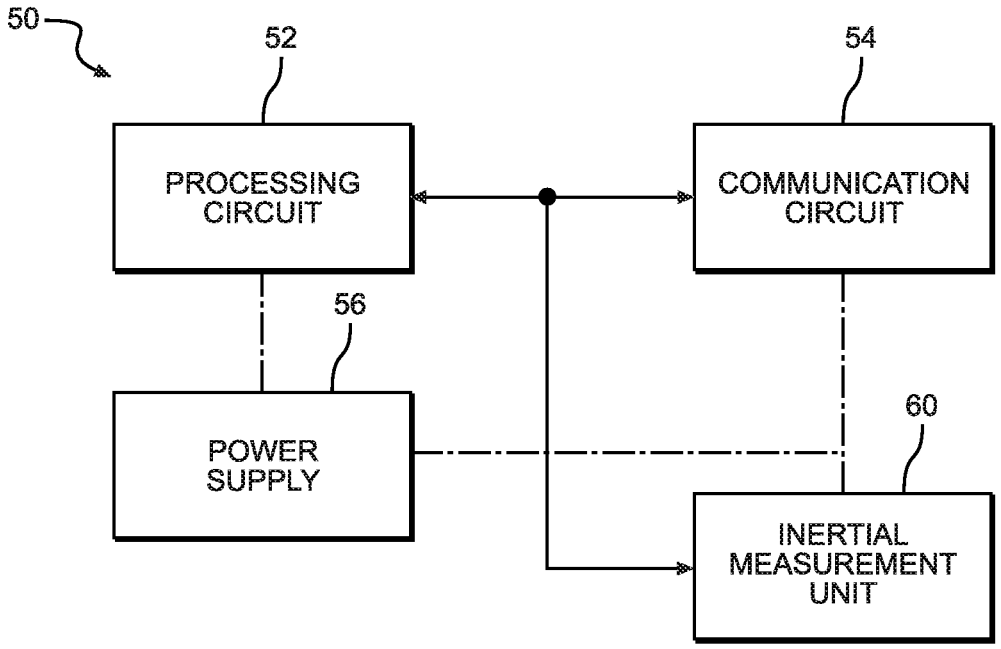
FIG. 2 is a block diagram of a first embodiment of the motion capture system.
Figure 3:
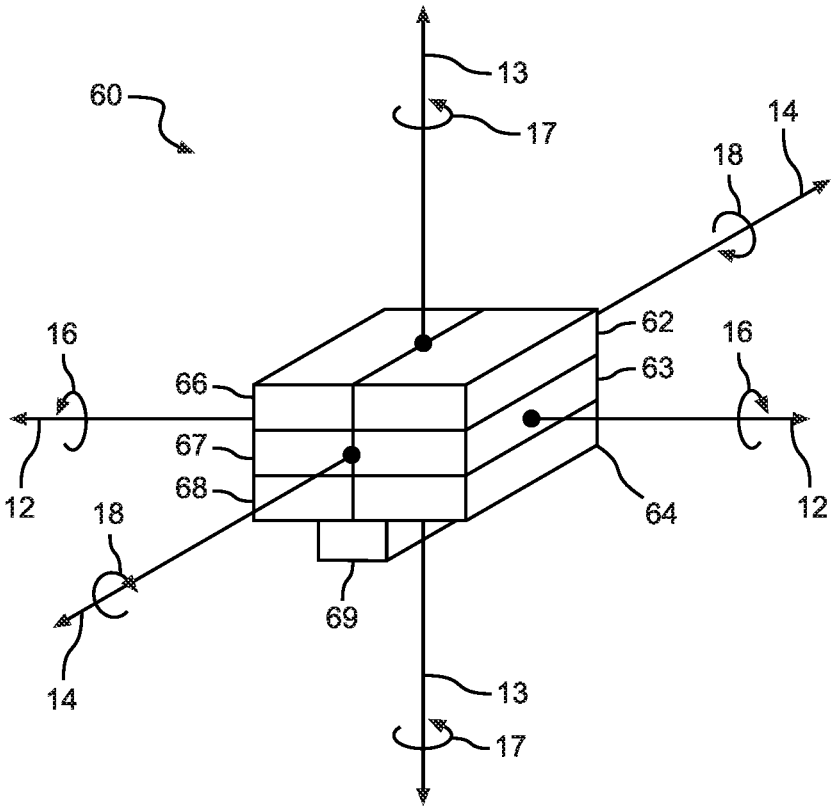
FIG. 3 is a perspective view of an example embodiment of an inertial measurement unit (IMU).

Some of the various embodiments of the present disclosure relate to a golf swing analyzer system that can analyze a golfer's golf swing. As best shown in FIG. 1, the golf swing analyzer system may include a golf club 20, a mat 40, a server 110, one or more computing devices (e.g., mobile computer 112, smart phone 114), and network 116. Some of the various embodiments of the present disclosure include a golf club 20, a network 116 and the server 110 and/or one or more computing devices (e.g., 112, 114). In other example embodiments, the golf swing analyzer system includes the golf club 20, a mat 40 and one computing device (e.g., 112, 114). An example embodiment may include a magnet 44 for indicating the time at or near impact of the head 30 of the golf club 20 with the golf ball 19. The magnet 44 may be adapted to be positioned on the mat 40.

Some of the various embodiments of the golf club 20, as best shown in FIGS. 1, 4-5, 10-11, 17 and 18, include the head 30, a shaft 22 and a motion capture system 50. In a first example embodiment of the motion capture system, a motion capture system 50 includes a processing circuit 52, a communication circuit 54, a power supply 56 and a first inertial measurement unit (IMU) 60. In a second example embodiment of the motion capture system, a motion capture system 70 includes the first IMU 60 and a second inertial measurement unit (IMU) 72. The first IMU 60 captures a first IMU data 80. The second IMU 72 captures a second IMU data 90.

The first IMU 60 may be oriented along a hosel-axis 32 and a face-axis 34 of the head 30 of the golf club 20 to simplify the mathematics required to determine the movement and/or orientation of the head 30. In the motion capture system 70, the second IMU 72 is oriented differently from the first IMU 60 to increase the accuracy of the collected data. As the golf club 20 is swung, the first IMU 60 and the second IMU 72 capture acceleration data (e.g., 82, 84, 86, 92, 94, 96), rotation data (e.g., 83, 85, 87, 93, 95, 97) and magnetic field data (e.g., 88, 98). The captured acceleration and rotation data describe the movement of the golf club 20, the orientation of the face 33 of the head 30, and the velocity of the head 30 during the swing. The magnetic field data identifies the time (e.g., 89, 99) at which the head 30 is at or near impact with the golf ball 19. The magnet 44 may be configured to be proximate to the one or more IMUs (e.g., 60, 72) when the head 30 is at or near impact with the golf ball 19.

The first IMU 60 and the second IMU 72 capture data at the same time, the first IMU data 80 and the second IMU data 90 have a common time base so the first IMU data 80 and the second IMU data 90 relate to each other in time. The motion capture system (e.g., 50, 70) may provide, as best shown in FIGS. 6-9, 12-14 and 17, the first IMU data 80 and the second IMU data 90 to the server 150 and/or the computing devices (e.g., 112, 114) to present the movement of the golf club 20 and the time at or near the impact (e.g., 89, 99) of the head 30 with the golf ball 19.

In the motion capture system 70, the captured data (e.g., 80, 90) from the first IMU 60 and the second IMU 72 may be used to determine corrected data to more accurately analyze and present the golf swing. Further, using the first IMU 60 and the second IMU 72 doubles the amount of data that can be collected during the swing. Additionally, the sampling times of the first IMU 60 and the second IMU 72 may be offset to more accurately sample the movement of the golf club.

Other example embodiments of the head 30 of the golf club 20 include an LED system 100. The LED system 100, as best shown in FIGS. 18-22, includes a first LED 102 and a second LED 104. The light from the LEDs provides a user with a visual indication of the path of the swing and the orientation of the face 33 of the golf club 20. An LED system 100 may cooperate with the mat 40, and with the centerline 42 along a length of the mat 40, to provide the visual indication of the path of travel and the orientation of the face 33 of the golf club 20 during the swing.

Figure 17A:
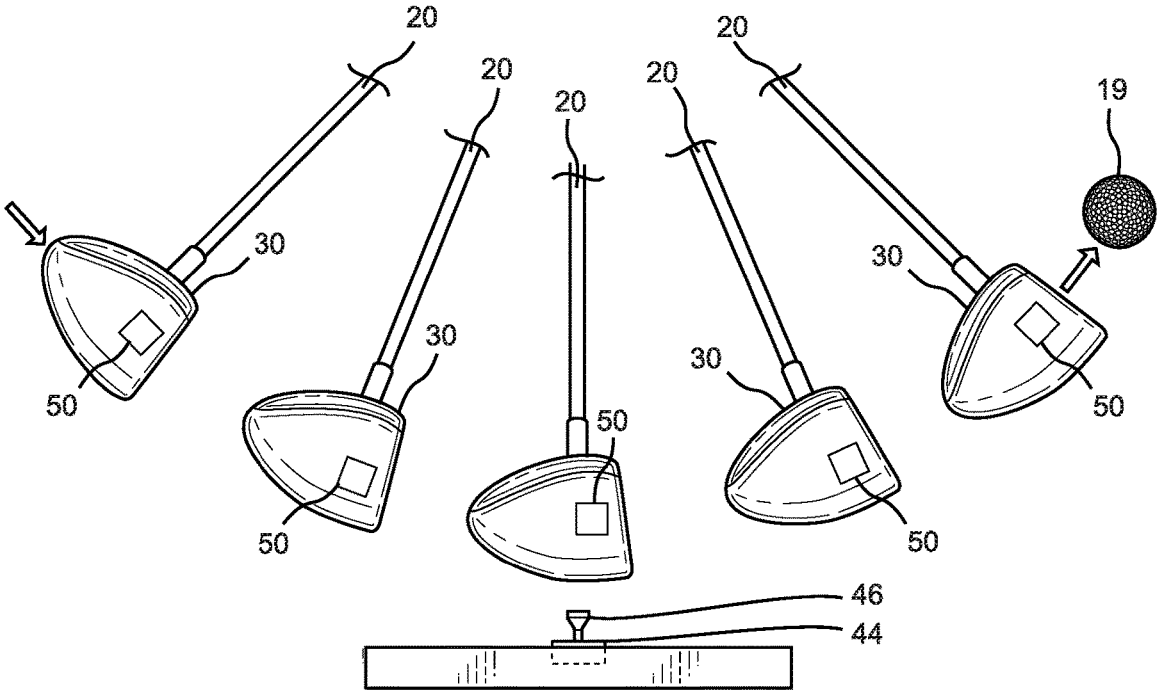
FIG. 17A is a diagram of an embodiment for detecting a maximum magnetic field strength to indicate a time at or near impact of the head of the golf club with the golf ball.
Figure 17B:
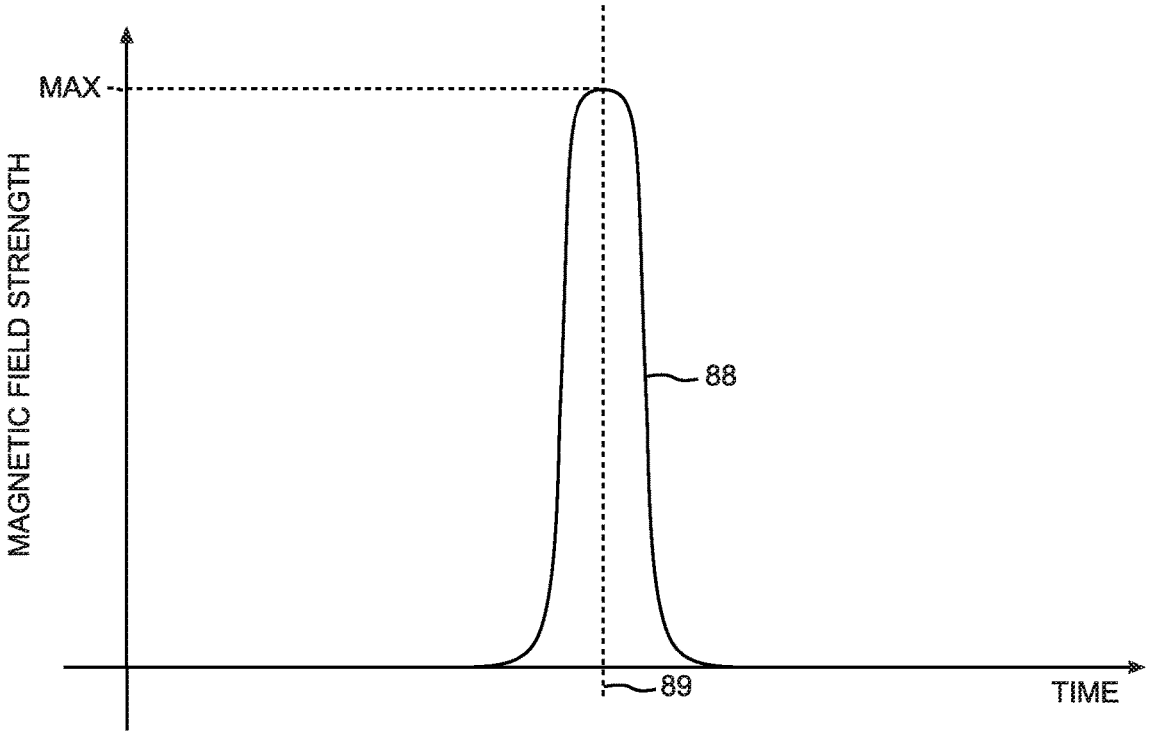
FIG. 17B is a diagram of the detected magnetic field strength of the embodiment of FIG. 17A.
Figure 18:
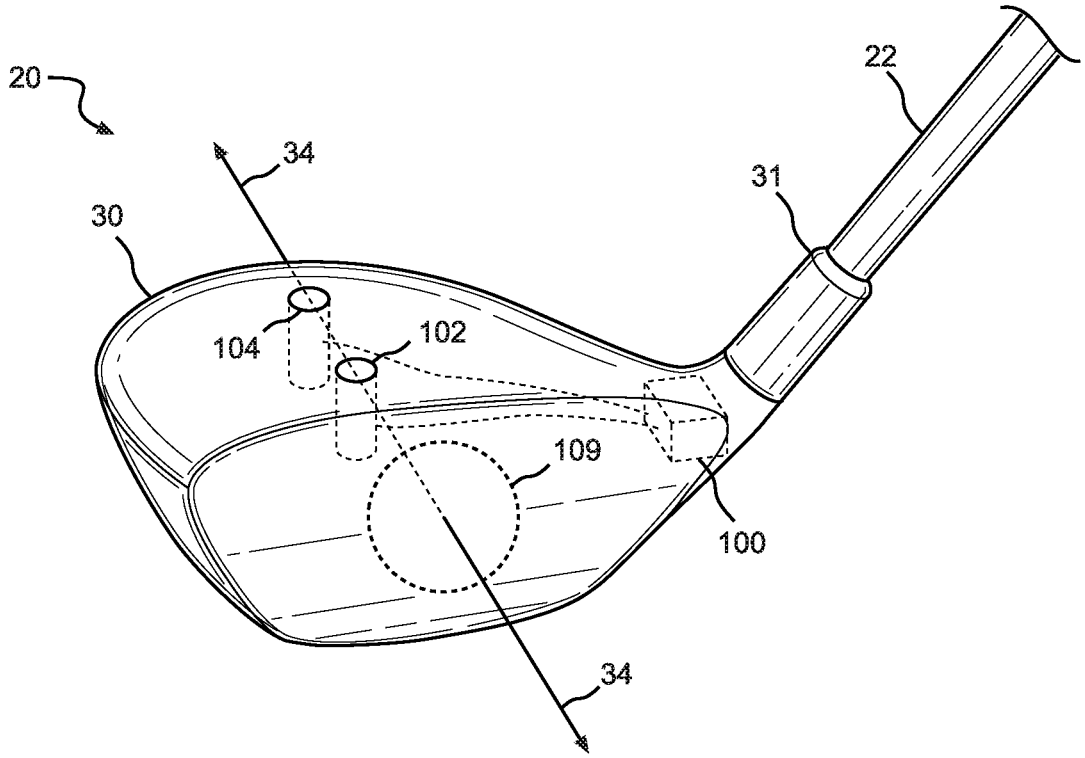
FIG. 18 is a perspective view of the golf club with the LED system.
Figure 19:
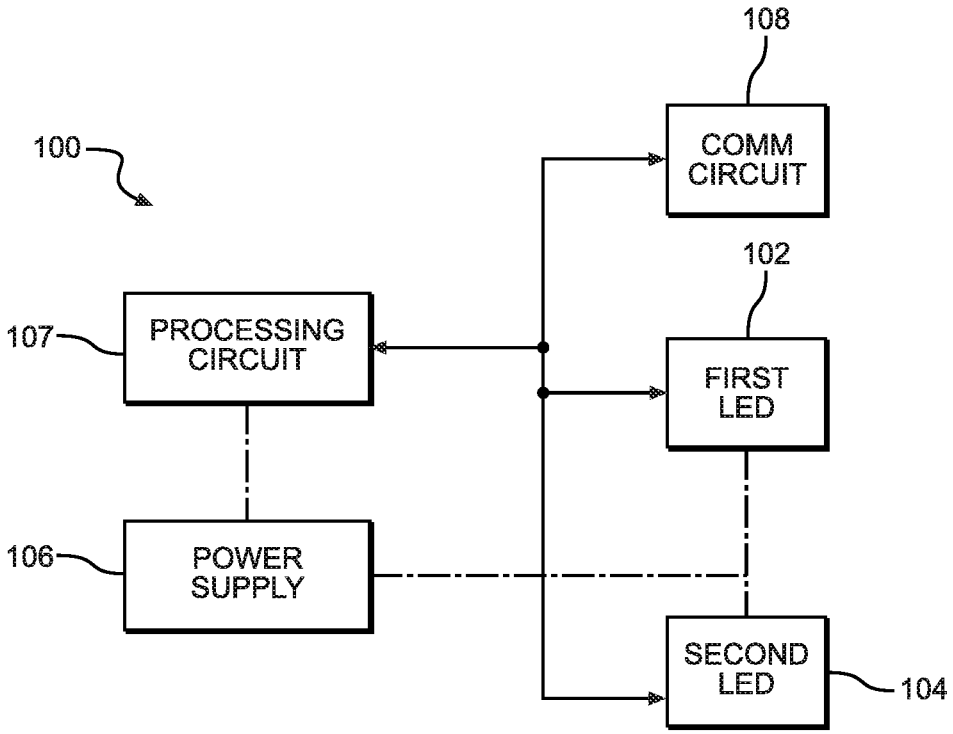
FIG. 19 is a block diagram of the example embodiment of the LED system.

In an example embodiment, the mat 40 includes the magnet 44, as best shown in FIGS. 1 and 17, that is adapted to indicate the time at or near impact of the head 30 of the golf club 20 with the golf ball 19. The magnet 44 may be adapted to be positioned proximate to a tee 46 that holds the golf ball 19. The magnet 44 may be adapted to position the tee 46 along the centerline 42 of the mat 40.

B. Golf Club

In an example embodiment, as best seen in FIGS. 1, 4-5, 10-11, 17-18, and 20-22, the golf club 20 collects (e.g., captures, samples) data for a golf swing analyzer system. A golf club 20 includes the head 30, a hosel 31 connected to the head 30 and a shaft 22 connected to the hosel 31. The head 30 of the golf club 20 includes the face 33 having a flat portion thereof. The golfer (e.g., user) grips the shaft 22 to swing the golf club 20.

A golf swing (e.g., stroke) begins as the user grips the shaft 22 usually while positioning the head 30 of the golf club 20 close to and behind the golf ball 19 that is positioned on the tee 46. When ready, the user draws the golf club 20 back, away from the golf ball 19, in what is referred to as the backswing. At the height of the backswing, the head 30 of the golf club 20 is positioned behind or to the side of the user. The user then begins the downstroke by moving the head 30 downward, usually rapidly, toward the golf ball 19. The downswing brings the head 30 into contact with the golf ball 19, as shown in FIG. 17. Contact between the head 30 and the golf ball 19 is referred to as impact of the head 30 with the golf ball 19. Impact forcefully moves the golf ball 19 off of the tee 46, away from the head 30 of the golf club 20, and if all goes well, down the fairway toward the flag on the green. Follow-through is the part of the golf swing that refers to the movement of the club after impact. After impact, the head 30 continues forward along the arc set by the backswing and sometimes around to the back of the user once again.

The motion of the head 30 during the swing, the velocity of the head 30 at the time at or near impact (e.g., 89, 99), and the orientation of the face 33 of the head 30 with respect to the golf ball 19 determines whether the golf ball 19 is hit in the direction of the flag on the green or in an undesirable direction. As a result, users generally want information as to the motion, velocity, and orientation of the head 30 during the swing, including at the time at or near impact, so that, if necessary, corrective action may be taken and/or additional training received.

At or near impact, it is preferable that the flat portion of the face 33 of the head 30 of the golf club 20 be oriented perpendicular to the desired direction of travel of the golf ball 19. In the example embodiment of the golf swing analyzer system that includes the mat 40, the centerline 42 of the mat is oriented in the desired direction of travel of the golf ball 19. So, the preferred orientation of the flat portion of the face 33 is perpendicular to the centerline 42 of the mat 40.

For the purpose of describing movement of the golf club 20 and the orientation of flat portion of the face 33 of the head 30, the terms the hosel-axis 32 and the face-axis 34 are used. The hosel-axis 32 is an axis that is along the central axis of the hosel 31 and the shaft 22. The face-axis 34 is an axis that is perpendicular to the flat portion of the face 33.

The orientation of the flat portion of the face 33 relates primarily to angular movement (e.g., rotation) around the hosel-axis 32. As a user rotates the shaft 22, the flat portion of the face 33 changes orientation as it rotates around the hosel-axis 32. Prior to the backstroke, the user generally rotates the shaft 22 to orient the flat portion of the face 33 perpendicular to the desired direction of travel of the golf ball 19.

Figure 6:
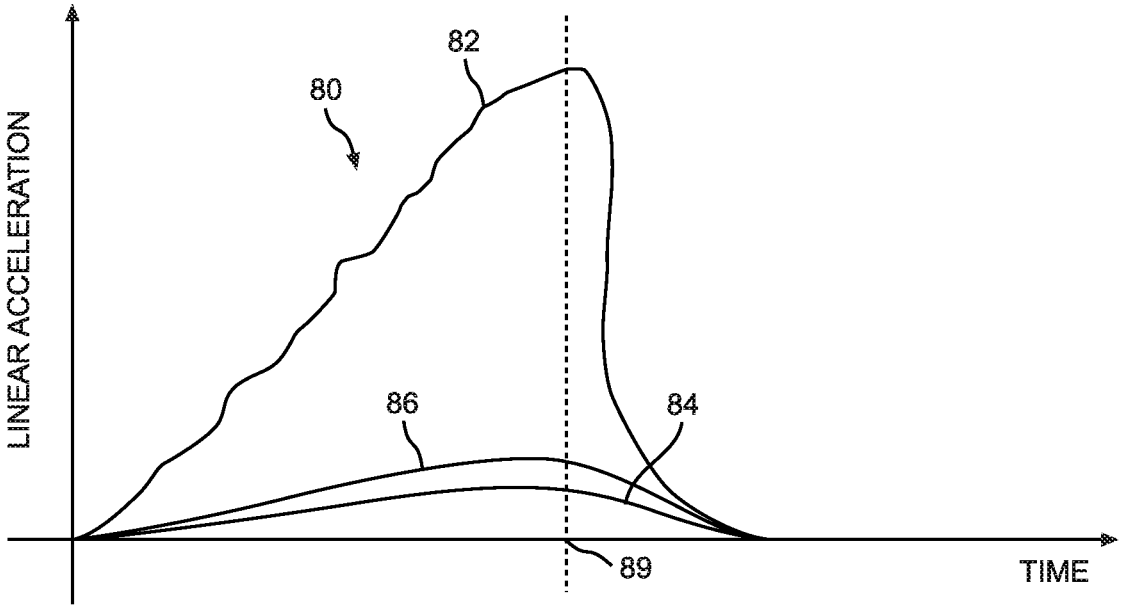
FIG. 6 is a diagram of acceleration data captured by the first IMU.
Figure 12:
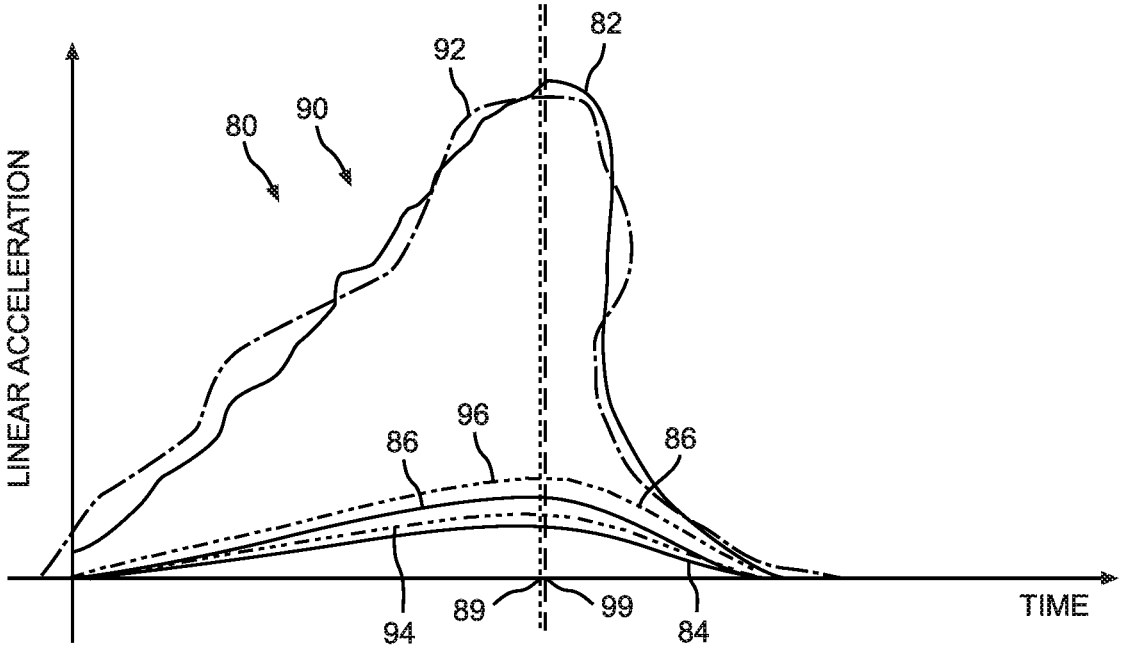
FIG. 12 is a diagram of acceleration data captured by the first IMU and the second IMU.

If the flat portion of the face 33 is oriented perpendicular to the desired direction of travel of the golf ball 19, then the face-axis 34 is oriented along the desired direction of travel of the golf ball 19. As discussed above, prior to the backstroke, the user generally orients the flat portion of the face 33 to be perpendicular the desired direction of travel. If the user maintains the flat portion of the face 33 perpendicular to the desired direction of travel during the downstroke (e.g., straight shot), and especially at or near impact, then the acceleration and/or velocity of the head 30 directly relates to the acceleration and/or velocity along the face-axis 34 as best shown in FIGS. 6 and 12.

The data that captures the rotation around the hosel-axis 32 (e.g., 85, 95) and the acceleration along the face-axis 34 (e.g., 82, 92), especially for a straight shot, may nearly completely describe the motion and velocity of the head 30 and the orientation of the flat portion of the face 33 during the swing, including at the time at or near impact. As a result, measuring acceleration along the face-axis 34 and rotation around the hosel-axis 32 may provide sufficient data to describe the motion, velocity and orientation of the head 30 of the golf club 20, especially at or near impact.

C. Detecting Impact

The golf swing analyzer system detects the impact of the head 30 of the golf club 20 with the golf ball 19. The golf swing analyzer system captures (e.g., collects) data from one or more sensors to determine the time at or near the impact of the head 30 with the golf ball 19. The golf swing analyzer system correlates the data captured by the one or more sensors to the data captured by the one or more IMUs (e.g., 60, 72). The one or more sensors may be positioned in any portion of the golf swing analyzer system (e.g., golf club 20, head 30, shaft 22, mat 40, motion capture system 50, motion capture system 70, first IMU 60, second IMU 72, tee 46, golf ball 19). The one or more sensors may report capture data in any format (e.g., digital, analog) via any type of communication link (e.g., wired, wireless). The golf swing analyzer system uses the data collected from the one or more sensors and/or the IMUs (e.g., 60, 72) to determine the time, the orientation of the face 33, the velocity of the head 30, and/or the path of movement of the head 30 at or near the time of impact of the head 30 with the golf ball 19.

In an example embodiment, the first IMU 60 and/or the second IMU 72 includes a magnetometer (e.g., magnetometer 69) for detecting the time at or near impact of the head with the golf ball 19. The data from the magnetometer may be correlated to the acceleration and rotation data captured by the first IMU 60 and/or the second IMU 72. This example embodiment is discussed in greater detail below.

In another example embodiment, the motion capture system 50, the motion capture system 70, the first IMU 60 and/or the second IMU 72 includes an impact sensor (e.g., shock sensor, inertia sensor). The impact sensor detects the impact of the head 30 with the golf ball 19. The impact sensor reports (e.g., provides notice of, provides a signal responsive to) the impact of the head 30 with the golf ball 19. The data from the impact sensor may be correlated to the acceleration and rotation data captured by the first IMU 60 and/or the second IMU 72.

In another example embodiment, the golf ball 19 includes an impact sensor. The impact sensor in the golf ball 19 detects and reports the impact of the head 30 with the golf ball 19. The data from the impact sensor in the golf ball 19 may be correlated to the acceleration and rotation data captured by the first IMU 60 and/or the second IMU 72.

In another example embodiment, the motion capture system 50, the motion capture system 70, the first IMU 60 and/or the second IMU 72 includes a position sensor (e.g., GPS receiver). The position sensor reports (e.g., provides data regarding) the position of the head 30. When the position of the head 30 coincides with the position of the golf ball 19, the head 30 is at or near impact with the golf ball 19. The data from the position sensor may be correlated to the acceleration and rotation data captured by the first IMU 60 and/or the second IMU 72. The position sensor may use any coordinate system for detecting and/or reporting the position of the head 30. The position of the golf ball 19 may be known value for analysis.

In another example embodiment, the golf swing analyzer system includes one or more high-speed cameras. The one or more high-speed cameras capture data (e.g., video data) regarding the movement of the head 30. In particular, the one or more high-speed cameras capture data regarding the movement of the head 30 at or near impact of the head 30 with the golf ball 19. The data captured by the one or more high-speed cameras may be analyzed to determine the time that the head 30 is at or near impact with the golf ball 19. The time determined by analysis of the data captured by the one or more high-speed cameras may be correlated to the acceleration and rotation data captured by the first IMU 60 and/or the second IMU 72. Any type of analysis and/or methods of analysis may be used to analyze the data from the one or more high-speed cameras to determine the time at or near impact of the head 30 with the golf wall 19. The methods of analysis may include methods employed by artificial intelligence.

In another example embodiment, the motion capture system 50, the motion capture system 70, the first IMU 60 and/or the second IMU 72 includes a three-axis magnetometer. The three-axis magnetometer measures magnetic field strength along three axes. The three axes may be oriented similarly as the three axes of the first IMU 60 and/or the second IMU 72. As discussed in more detail herein, the magnet 44 may be positioned proximate to the golf ball 19 and/or the tee 46. As the head 30 moves, the three-axis magnetometer captures data regarding the strength of the magnetic field it detects in three dimensions. In particular, the three-axis magnetometer measures the strength of the magnetic field of the magnet 44 in three dimensions at or near impact of the golf head 30 with the golf ball 19. The data captured by the three-axis magnetometer may be used to determine the time at or near impact of the head 30 with the golf ball 19. The data captured by the three-axis magnetometer may be correlated to the acceleration and rotation data captured by the first IMU 60 and/or the second IMU 72. Further, the data captured by the three-axis magnetometer may be used to determine the orientation of the face 33 of the head 30 with respect to the golf ball 19. The data from the three-axis magnetometer may be further analyzed to determine whether the sweet spot 36 on the face 33, as opposed to some other portion of the head 30 (e.g., toe), impacted with the golf ball 19.

In another example embodiment, the golf swing analyzer system include a strain gauge positioned in mat 40 and/or tee 46. The strain gauge detects the impact of the head 30 with the golf ball 19. The strain gauge reports the impact of the head 30 with the golf ball 19. The data from the strain gauge may be correlated to the acceleration and rotation data captured by the first IMU 60 and/or the second IMU 72.

D. First Inertial Measurement Unit (IMU)

The first inertial measurement unit (IMU) 60, as best shown in FIGS. 2-5, includes an x-axis accelerometer 62, a y-axis accelerometer 63 and a z-axis accelerometer 64, which are linear accelerometers respectively oriented along an x-axis 12, a y-axis 13 and a z-axis 14. The x-axis 12, y-axis 13 and z-axis 14 are mutually orthogonal (e.g., 3D Cartesian coordinate system). The x-axis accelerometer 62 detects linear acceleration along the x-axis 12. The y-axis accelerometer 63 detects linear acceleration along the y-axis 13. The z-axis accelerometer 64 detects linear acceleration along the z-axis 14.

The first IMU 60 further includes an x-axis gyroscope 66, a y-axis gyroscope 67 and a z-axis gyroscope 68, which are respectively oriented to detect rotation (e.g., angular acceleration, rotational acceleration) around the x-axis (e.g., x-rotation 16), around the y-axis (e.g., y-rotation 17) and around the z-axis (z-rotation 18) respectively.

The first IMU 60 further includes a magnetometer 69. The magnetometer 69 measures magnetic field strength. As the magnetometer 69 approaches a magnetic field, for example the magnetic field from a magnet, the magnetometer 69 measures the strength of the magnetic field. The magnet 44 may be positioned proximate to the golf ball 19 and/or the tee 46, so that the strength of the magnetic field measured by the magnetometer 69 at or near the time of impact of the head 30 with the golf ball 19 is a maximum magnetic field strength.

Figure 7:
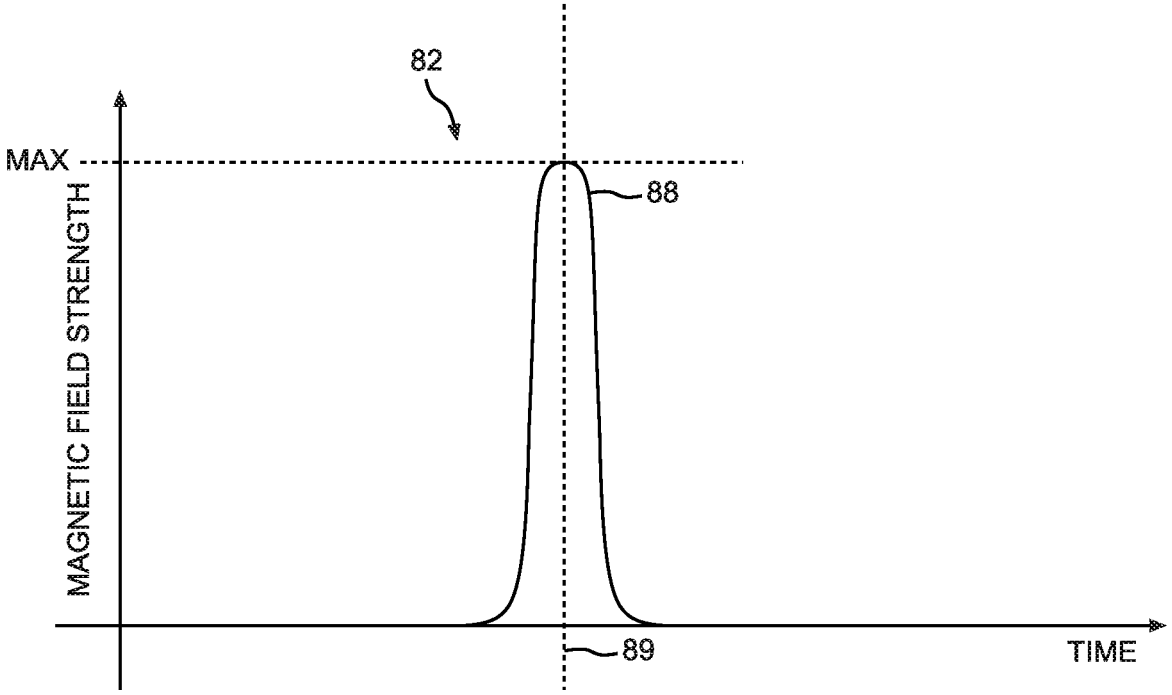
FIG. 7 is a diagram of magnetic field data captured by the first IMU.
Figure 8:
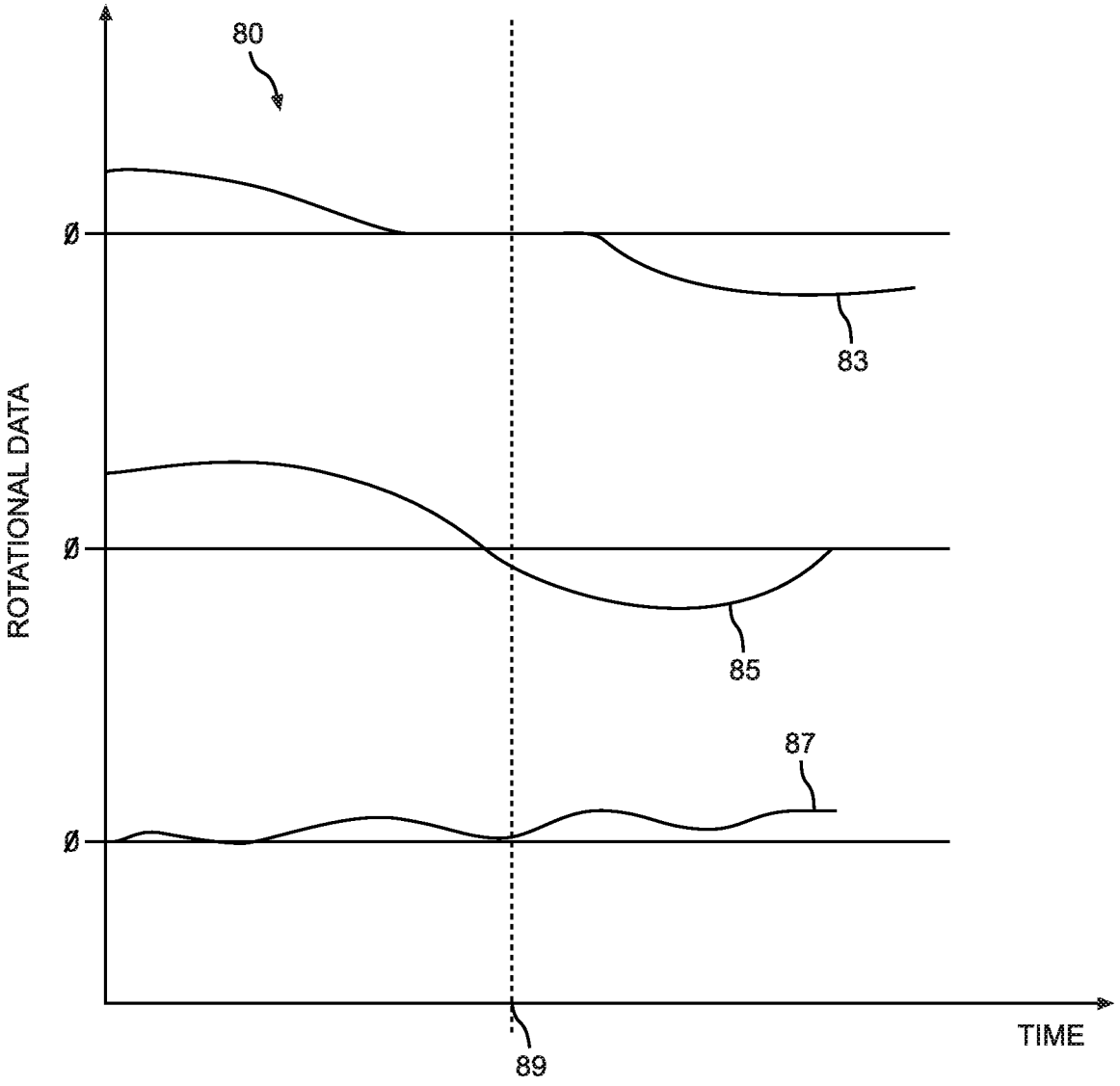
FIG. 8 is a diagram of rotation data captured by the first IMU.
Figure 9:
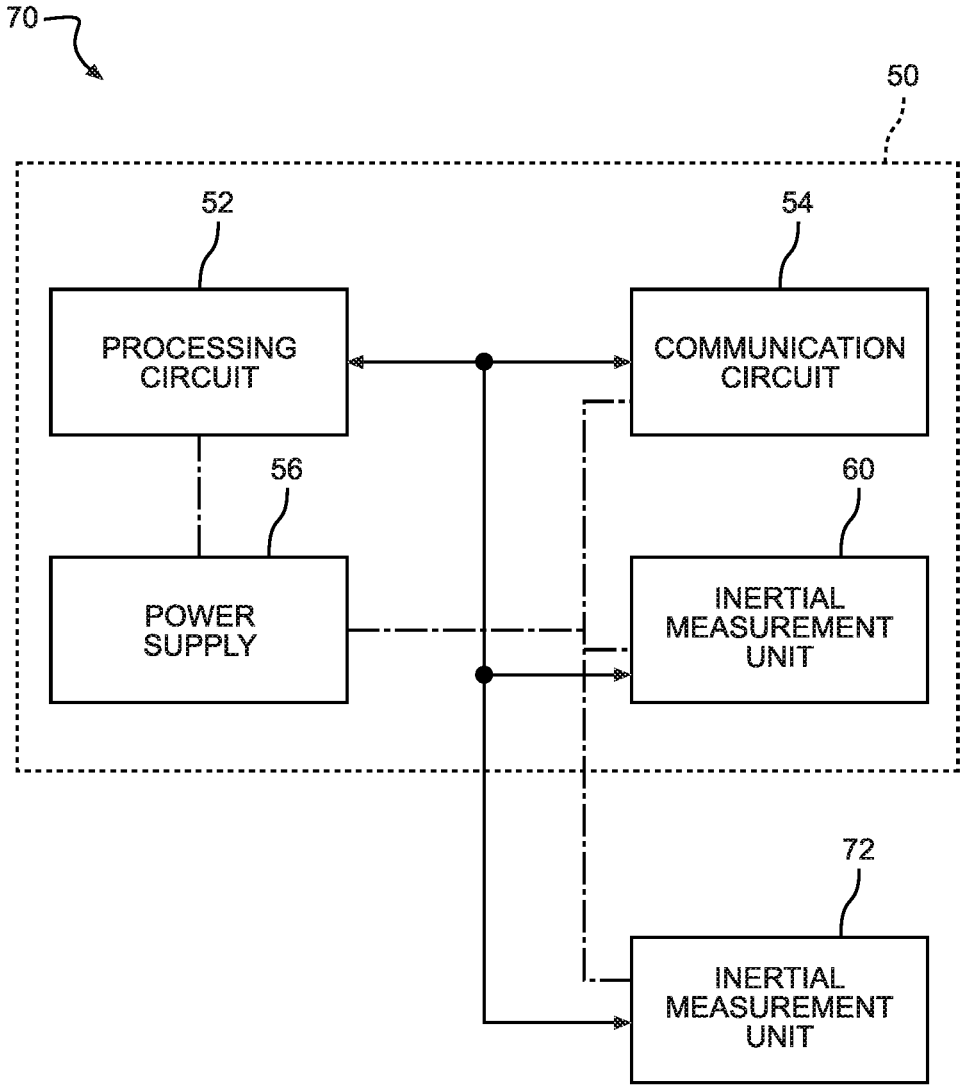
FIG. 9 is a block diagram of a second embodiment of the motion capture system.

In operation, the first IMU 60 continuously measures linear acceleration along and rotation around its x-axis 12, y-axis 13 and z-axis 14 and the magnetic field. The first IMU 60 periodically captures the first IMU data 80, which includes, as best seen in FIGS. 6-8, acceleration data (e.g., 82, 84, 86), rotation data (e.g., 83, 85, 87) and magnetic field data (e.g., 88). The acceleration data captured by the first IMU 60 includes acceleration data from the x-axis accelerometer 62, the y-axis accelerometer 63 and the z-axis accelerometer 64. The rotation data captured by the first IMU 60 includes rotation data from the x-axis gyroscope 66, the y-axis gyroscope 67 and the z-axis gyroscope 68. The magnetic field data captured by the first IMU 60 includes the magnetic field strength measured by the magnetometer 69. Since the acceleration data, the rotation data and the magnetic field data is captured at the same time, acceleration data, the rotation data and the magnetic field data have a common time base, as discussed above.

Figure 4:
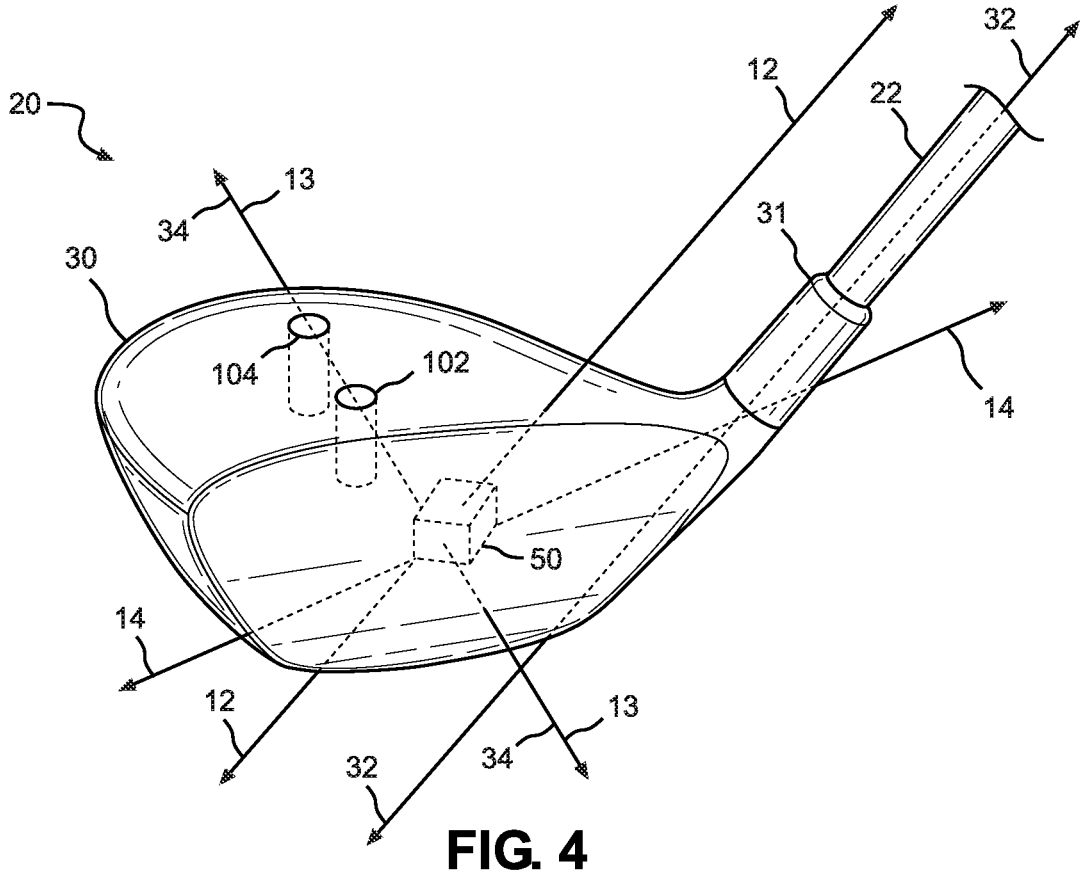
FIG. 4 is a perspective view of the golf club with the first embodiment of the motion capture system and an example embodiment of the LED system.
Figure 5:
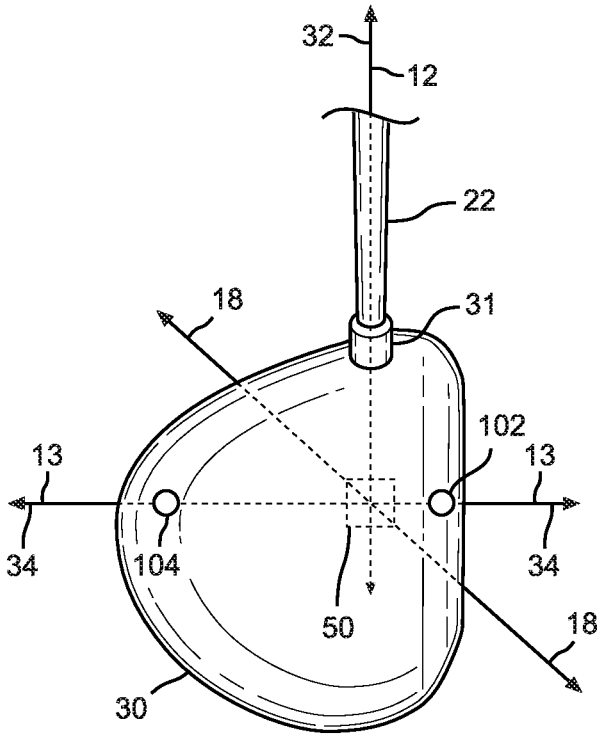
FIG. 5 is a top view of the golf club with the first embodiment of the motion capture system and the example embodiment of the LED system.

The first IMU 60 is part of the motion capture system 50 and the motion capture system 70. As discussed above, in an example embodiment, the motion capture system 50 is positioned inside head 30, which means that the first IMU 60 is also positioned inside the head 30. The first IMU 60 may be positioned at the center of gravity of the head 30 of the golf club 20. The first IMU 60 is not only positioned inside the head 30, but is also oriented with respect to the head 30. In an example embodiment of the motion capture system 50, as best shown in FIGS. 4-5, the first inertial measurement unit (IMU) 60 has an x-axis 12, a y-axis 13 and a z-axis 14 as discussed above. The first IMU 60 is positioned in the head 30. The first IMU 60 is oriented to position the x-axis of the first IMU 60 parallel to a central axis of the hosel 31 (e.g., along or parallel to the hosel-axis 32) and the y-axis of the first IMU 60 perpendicular to the flat portion of the face 33 (e.g., along or parallel to the face-axis 34).

While the x-axis 12 and the y-axis 13 of the first IMU 60 are oriented along or parallel to the hosel-axis 32 and the face-axis 34 respectively, the first IMU 60 captures, as best shown in FIGS. 6-8 and 12-14, the first IMU data 80. The first IMU data 80 includes a face-axis linear acceleration data 82 along the face-axis 34 (e.g., y-axis of the first IMU 60), a hosel-axis linear acceleration data 84 along to the hosel-axis 32 (e.g., x-axis of the first IMU 60), a z-axis linear acceleration data 86 along the z-axis of the first IMU 60, a face-axis rotation data 83 around the face-axis 34 (e.g., y-axis of the first IMU 60), a hosel-axis rotation data 85 around the hosel-axis 32 (e.g., x-axis of the first IMU 60), a z-axis rotation data 87 around the z-axis of the first IMU 60 and a magnetic field data 88.

In an example implementation, during a swing of the golf club 20, the first IMU 60 is configured to capture the first IMU data 80, which includes the acceleration data (e.g., 82, 84, 86) along at least the y-axis (e.g., face-axis 34) of the first IMU 60 (e.g., face-axis linear acceleration data 82), the rotation data (e.g., 83, 85, 87) around at least the x-axis (e.g., hosel-axis 32) of the first IMU 60 (e.g., hosel-axis rotation data 85), and the magnetic field data (e.g., 88). At or near an impact of the head 30 with the golf ball 19, the first IMU 60 detects the maximum magnetic field strength of the magnetic field data 88. The maximum magnetic field strength corresponds to the time at or near the impact (e.g., 89) of the head 30 with the golf ball 19.

In another example implementation, the first inertial measurement unit (IMU) 60 has an x-axis, a y-axis and a z-axis. The first IMU 60 is positioned in the head 30. The first IMU 60 is oriented to position the x-axis of the first IMU 60 parallel to a central axis of the hosel 31 and the y-axis of the first IMU 60 perpendicular to the flat portion of the face 33. During a swing of the golf club 20, the first IMU 60 is configured to capture the first IMU data 80, which includes an acceleration data (e.g., 82, 84, 86) along at least the y-axis (e.g., 82) of the first IMU 60, a rotation data (e.g., 83, 85, 87) around at least the x-axis (e.g., 85) of the first IMU 60, and a magnetic field data 88. At or near an impact of the head 30 with a golf ball 19, the magnet 44 is adapted to be positioned proximate to the first IMU 60, so the first IMU 60 measures the maximum magnetic field strength of the magnetic field data 88. The maximum magnetic field strength corresponds to a time at or near the impact of the head 30 with the golf ball 19.

During the swing of the golf club 20, referring to FIG. 6, the face-axis linear acceleration data 82 is significantly greater than the hosel-axis linear acceleration data 84 and the z-axis linear acceleration data 86 because the face-axis 34 oriented in the direction of the swing. The movement and velocity of the head 30, especially at the time at or near impact 89, depends primarily on face-axis linear acceleration data 82 because linear acceleration along the hosel-axis 32 and the z-axis of the first IMU 60 is not in the direction of the swing, so their linear accelerations are negligible. Also, during the swing of the golf club 20, the orientation of the face 33 is primarily related to the hosel-axis rotation data 85, as opposed to the face-axis rotation data 83 and the z-axis rotation data 87 because rotation around the hosel-axis 32 directly affects the orientation of the face 33.

So, in an example embodiment, the velocity of the head 30 of the golf club 20 at the time at or near the impact (e.g., 89) relates primarily to a velocity along the y-axis of the first IMU 60 (e.g., face-axis 34). In an example embodiment, the orientation of the flat portion of the face 33 at the time at or near the impact (e.g., 89) relates primarily to a rotation around the x-axis of the first IMU 60 (e.g., hosel-axis 32).

E. Second Inertial Measurement Unit (IMU)

The second inertial measurement unit (IMU) 72 is the same as the first IMU 60. The second IMU 72 has an x-axis 12, a y-axis 13 and a z-axis 14. The second IMU 72 includes three linear accelerators (e.g., 62, 63, 64) that detect linear acceleration along the x-axis 12, y-axis 13 and z-axis 14 respectively, three gyroscopes (e.g., 66, 67, 68) that detect rotation around the x-axis 12, y-axis 13 and z-axis 14 respectively, and a magnetometer (e.g., 69). In an example embodiment of the second IMU 72, the magnetometer 69 is omitted. Like the x-axis 12, y-axis 13 and z-axis 14 of the first IMU 60, x-axis 12, y-axis 13 and z-axis 14 of the second IMU 72 are mutually orthogonal.

Figure 10:
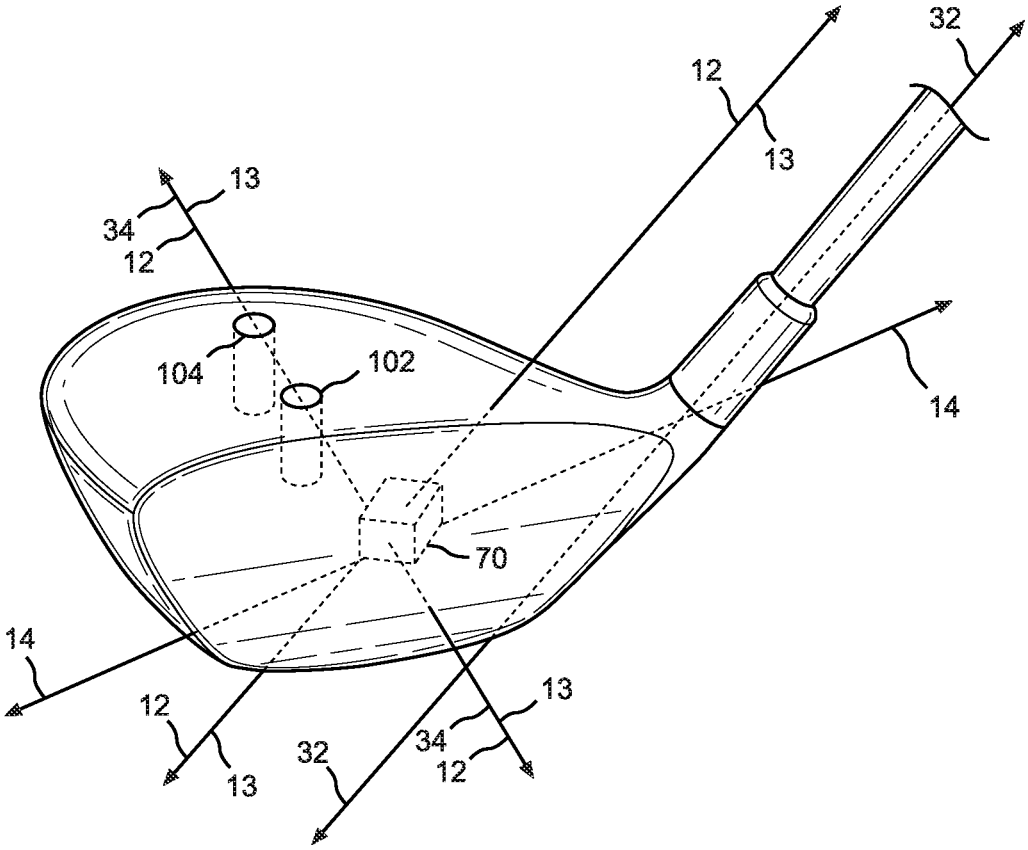
FIG. 10 is a perspective view of the golf club with the second embodiment of the motion capture system and the example embodiment of the LED system.
Figure 11:
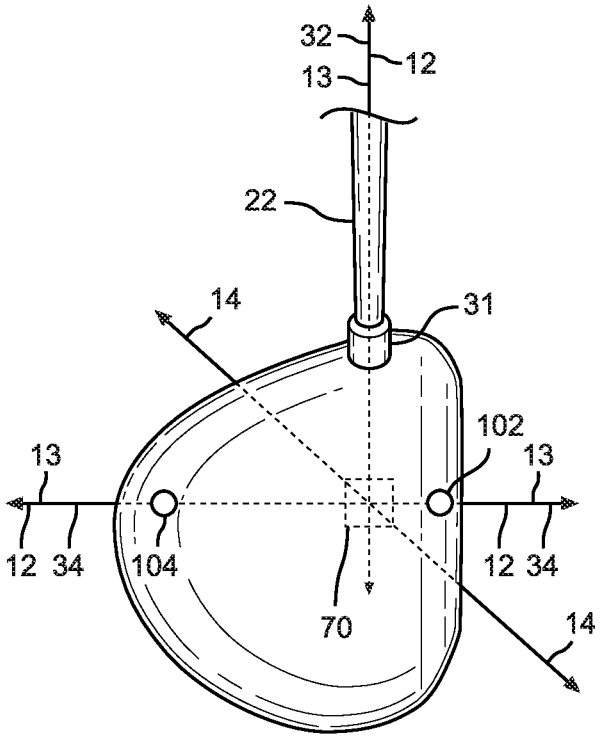
FIG. 11 is a top view of the golf club with the second embodiment of the motion capture system and the example embodiment of the LED system.

As with the first IMU 60, the second IMU 72 may be positioned in the head 30 of the golf club 20. The second IMU 72 may be positioned at the center of gravity of the head 30 of the golf club 20. As with the first IMU 60, the second IMU 72 is also oriented with respect to the head 30, however the orientation of the second IMU 72 with respect to the head 30 does not need to be the same orientation as the first IMU 60. In an example embodiment, as best shown in FIGS. 10-11, the x-axis and y-axis of the second IMU 72 are oriented along or parallel to the face-axis 34 and the hosel-axis 32 respectively, which means that the z-axis of the second IMU 72 is oriented along or parallel to the z-axis of the first IMU 60.

In other words, in an example embodiment, the x-axis and y-axis of the first IMU 60 and the second IMU 72 respectively are oriented along or parallel to the hosel-axis 32 while the y-axis and x-axis of the first IMU 60 and the second IMU 72 respectively are oriented along or parallel to the face-axis 34. The alignment of the x-axis and the y-axis of the first IMU 60 and the second IMU 72 in along or parallel to the same axis provides data that may be used to reduce error. For example, the error of the x-axis measurement of an IMU may be twice the error of the y-axis, so orienting the x-axis of one IMU and the y-axis of another IMU along the same axis allows errors to be detected and corrected. In an example embodiment, aligning the x-axis and y-axis of the first IMU 60 and the second IMU 72 respectively as discussed above, may reduce measurement errors by a factor of two.

Figure 13:
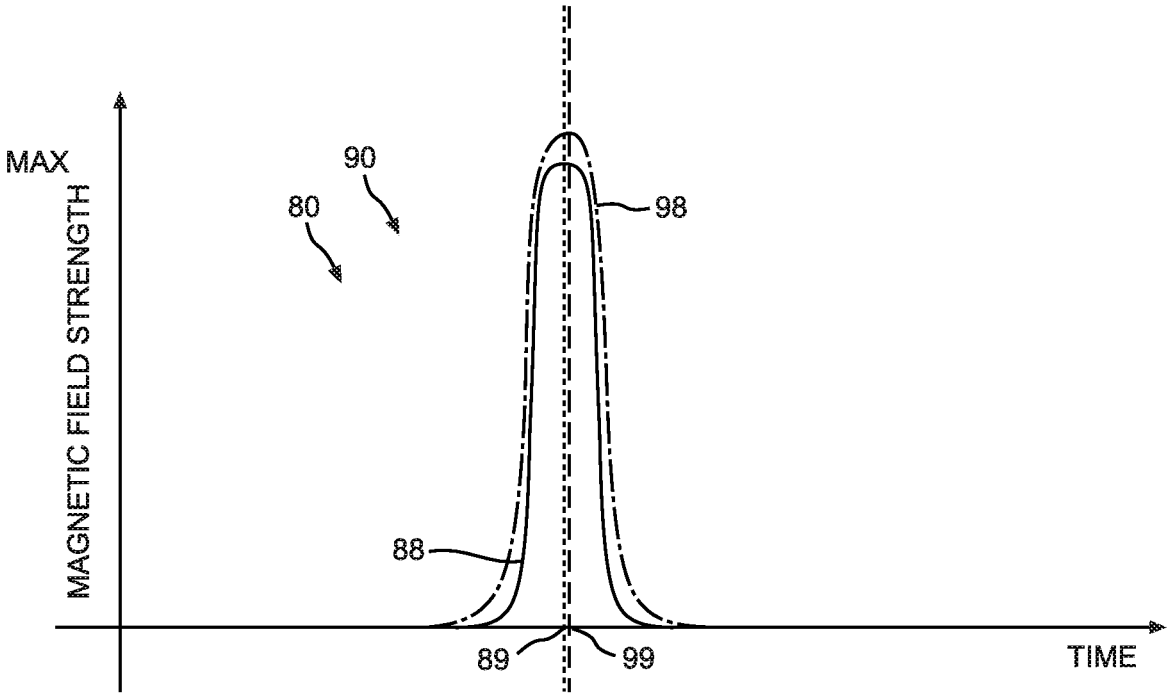
FIG. 13 is a diagram of magnetic field data captured by the first IMU and the second IMU.
Figure 14:
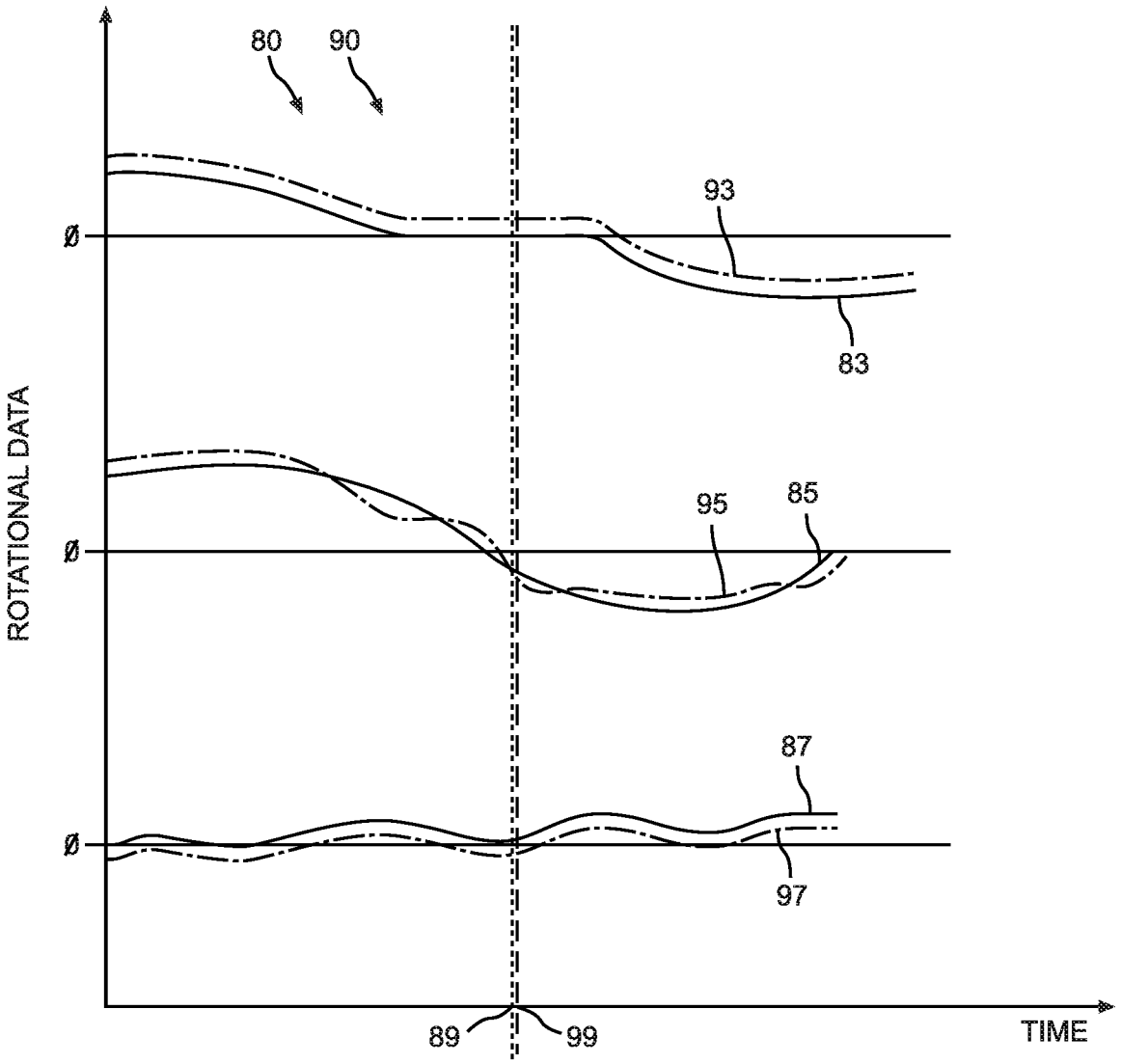
FIG. 14 is a diagram of rotation data captured by the first IMU and the second IMU.

While the y-axis and x-axis of the second IMU 72 are oriented along or parallel to the hosel-axis 32 and the face-axis 34 respectively, the second IMU 72 captures, as best shown in FIGS. 12-14, the second IMU data 90. The second IMU data 90 includes a face-axis linear acceleration data 92 along the face-axis 34 (e.g., x-axis of the second IMU 72), a hosel-axis linear acceleration data 94 along to the hosel-axis 32 (e.g., y-axis of the second IMU 72), a z-axis linear acceleration data 96 along the z-axis of the second IMU 72, a face-axis rotation data 93 around the face-axis 34 (e.g., x-axis of the second IMU 72), a hosel-axis rotation data 95 around the hosel-axis 32 (e.g., y-axis of the second IMU 72), a z-axis rotation data 97 around the z-axis of the second IMU 72 and a magnetic field data 98.

In an example, the golf club 20 includes the second IMU 72 that has an x-axis, a y-axis and a z-axis. The second IMU 72 is positioned in the head 30. The second IMU 72 is oriented to position the y-axis of the second IMU 72 parallel to the central axis of the hosel 31 and the x-axis of the second IMU 72 perpendicular to the flat portion of the face 33. During the swing of the golf club 20, the second IMU 72 is configured to capture the acceleration data (e.g., 92, 94, 96) along at least the x-axis (e.g., face-axis 34) of the second IMU 72 and a rotation data (e.g., 93, 95, 97) around at least the y-axis (e.g., hosel-axis 32) of the second IMU 72.

In another example embodiment, the motion capture system 70 further includes the second IMU 72 that is also oriented to position the y-axis of the second IMU 72 parallel to the central axis of the hosel 31 and the x-axis of the second IMU 72 perpendicular to the flat portion of the face 33. During the swing of the golf club 20, the processing circuit 52 of the motion capture system 70 stores the acceleration data (e.g., 92, 94, 96) and the rotation data (e.g., 93, 95, 97) using data captured by the second IMU 72. The second acceleration data (e.g., 92, 94, 96) includes an acceleration data captured along at least the x-axis of the second IMU 72 (e.g., face-axis linear acceleration data 92) and the second rotation data (e.g., 93, 95, 97) includes a rotation data captured around at least the y-axis of the second IMU 72 (e.g., hosel-axis rotation data 95).

During the swing of the golf club 20, the face-axis linear acceleration data 92, as best shown in FIG. 12, is significantly greater than the hosel-axis linear acceleration data 94 and the z-axis linear acceleration data 96 because the face-axis 34 in the direction of the swing. The movement and velocity of the head 30, especially at the time at or near impact 99, depends primarily on the face-axis linear acceleration data 92 because linear acceleration along the hosel-axis 32 and the z-axis of the second IMU 72 is not in the direction of the swing, so their linear accelerations are negligible. As discussed above, the same applies to face-axis linear acceleration data 82. Also, during the swing of the golf club 20, the orientation of the face 33 is primarily related to the hosel-axis rotation data 95, as opposed to the face-axis rotation data 93 and the z-axis rotation data 97 because rotation around the hosel-axis 32 directly affects the orientation of the face 33. As discussed above, the same applies to the hosel-axis rotation data 85.

So, in an example embodiment, the velocity of the head 30 of the golf club 20 at the time at or near the impact (e.g., 89, 99) relates primarily to a velocity along the y-axis of the first IMU 60 and a velocity along the x-axis of the second IMU 72. In an example embodiment, the orientation of the flat portion of the face 33 at the time at or near the impact (e.g., 89, 99) relates primarily to a rotation around the x-axis of the first IMU 60 and the y-axis of the second IMU 72.

F. Motion Capture System

Two example embodiments of a motion capture system are discussed herein. In the first example embodiment, the motion capture system 50 includes the processing circuit 52, the communication circuit 54, the power supply 56 and the first IMU 60. The first IMU has an x-axis 12, a y-axis 13 and a z-axis 14, as discussed above. In an example embodiment, the motion capture system 50 is positioned in the head 30 of the golf club 20. In an example embodiment, the motion capture system 50 is positioned in the head 30 at the center of gravity of the head 30. The power supply 56 provides electrical power to the processing circuit 52, the communication circuit 54 and the first IMU 60, so that they may operate.

In the second example embodiment, the motion capture system 70 includes the processing circuit 52, the communication circuit 54, the power supply 56, the first IMU 60 and the second IMU 72. The first IMU 60 and the second IMU 72 respectively have an x-axis 12, a y-axis 13 and a z-axis 14, as discussed above. In an example embodiment, the motion capture system 70 is positioned in the head 30 of the golf club 20. In an example embodiment, the motion capture system 70 is positioned in the head 30 at the center of gravity of the head 30. The power supply 56 provides electrical power to the processing circuit 52, the communication circuit 54, the first IMU 60 and the second IMU 72, so that they may operate.

The motion capture system (e.g., 50, 70) stores (e.g., saves, records) the data (e.g., 80, 90) regarding movement of the golf club 20 as captured by the first IMU 60 and the second IMU 72. The communication circuit 54 communicates with (e.g., transmits to, receive from) the server 110, the mobile computer 112 (e.g., computing device) and/or the smart phone 114 (e.g., computing device). The communication circuit 54 may communicate using a wired and/or wireless communication link. The communication circuit 54 may communicate with the server 110 and/or the computing devices (e.g., 112, 114) via the network 116. The communication circuit 54 may communicate using any wired or wireless communication protocol. For example, in an example embodiment, the communication circuit 54 communicates using the Bluetooth wireless communication protocol. In another example embodiment, the communication circuit 54 communicates using an 802.11 communication protocol.

In an example embodiment, the communication circuit 54 transmits the acceleration data (e.g., 82, 84, 86) of the first IMU 60, the rotation data (e.g., 83, 85, 87) of the first IMU 60 and the magnetic field data (e.g., 88) to a server 110 and/or a computing device (e.g., 112, 114) of the golf swing analyzer system. In another example embodiment, the communication circuit 54 transmits the acceleration data (e.g., 92, 94, 96) of the second IMU 72, the rotation data (e.g., 93, 95, 97) of the second IMU 72 and the magnetic field data (e.g., 98) to a server 110 and/or a computing device (e.g., 112, 114) of the golf swing analyzer system. In another example embodiment, the communication circuit 54 transmits the first IMU data 80 and the second IMU data 90 to a server 110 and/or a computing device (e.g., 112, 114) of the golf swing analyzer system.

The processing circuit 52 controls (e.g., coordinates) the operation of the motion capture system (e.g., 50, 70). The processing circuit 52 may provide data to and/or receive data from the communication circuit 54. The processing circuit 52 may receive data from the first IMU 60 and/or the second IMU 72. The processing circuit 52 may include a memory (not shown). The processing circuit 52 may store data received from first IMU 60, the second IMU 72 and/or the communication circuit 54. The processing circuit 52 may execute a program stored in the memory to perform its operations.

In an example embodiment, the processing circuit 52 receives and stores data from the first IMU 60 and the second IMU 72. The processing circuit 52 provides the data from the first IMU 60 and the second IMU 72 to the communication circuit 54 for transmission to the server 110 and/or one or more of the computing devices (e.g., 112, 114). The processing circuit 52 may receive data from the first IMU 60 and/or the second IMU 72 by periodically reading (e.g., capturing) data from registers of the first IMU 60 and/or the second IMU 72.

The processing circuit 52 may also perform operations on data. The processing circuit 52 may perform calculations using data, transform data using mathematical formulas, and/or combine data. The processing circuit 52 may store data after performing an operation on the data. In an example embodiment, the processing circuit 52 uses the acceleration data (e.g., 82, 84, 86), the rotation data (e.g., 83, 85, 87) and the magnetic field data (e.g., 88) from the first IMU 60 to determine (e.g., calculate) the velocity of the head 30 and/or an orientation of the face 33 of the golf club 20. In an example embodiment, the processing circuit 52 uses the acceleration data, the rotation data and the magnetic field data from the first IMU 60 to determine the velocity of the head 30 and/or an orientation of the flat portion of the face 33 at the time at or near the impact (e.g., 89) of the head 30 with golf ball 19.

In an example embodiment, the processing circuit 52 uses the acceleration data, the rotation data and the magnetic field data from the first IMU 60 to further determine the path of travel of the head 30. In an example embodiment, the processing circuit 52 may use the acceleration data (e.g., 82, 84, 86), the rotation data (e.g., 83, 85, 87) and the magnetic field data (e.g., 88) from the first IMU 60 to further determine the path of travel of the head 30 at the time at or near the impact of the head 30 with golf ball 19.

The processing circuit 52 may also use the data from the second IMU 72 (e.g., second IMU data 90) to determine the velocity of the head 30, the orientation of the face 33, and/or the path of travel of the head 30. The processing circuit 52 may use the data from the second IMU 72 to determine the velocity of the head 30, the orientation of the face 33, and/or the path of travel of the head 30 at the time at or near the impact of the head 30 with golf ball 19.

As discussed above, the velocity of the head 30 may relate primarily to data collected along the face-axis 34. So, the processing circuit 52 may primarily use linear acceleration data (e.g., 82, 92) captured from along the face-axis 34 to calculate the velocity of the head 30. The linear acceleration data along all axes (e.g., 82, 84, 86) may be used to determine the path of travel of the head 30. As discussed above, the orientation of the flat portion of the face 33 may relate primarily to data collected around the hosel-axis 32. So, the processing circuit 52 may primarily use rotation data (e.g., 85, 95) captured from around the hosel-axis 32 to calculate the orientation of the face 33.

The processing circuit 52 may access the magnetic field data (e.g., 88 and/or 98) to determine the time at or near impact (e.g., 89, 99). The processing circuit 52 may then use the time at or near impact to access (e.g., read) the acceleration data (e.g., 82, 84, 86, 92, 94, 96) and the rotation data (e.g., 83, 85, 87, 93, 95, 97) to determine the path of travel of the head 30, the velocity of the head 30 and the orientation of the face 33 at the time at or near impact of the head 30 with the golf ball 19.

G. Corrected Data

As discussed above, the first IMU 60 and the second IMU 72 may be oriented with respect to the golf club 20 and with respect each other to provide data correction and greater accuracy. The data from the first IMU 60 (e.g., first IMU data 80) may be used with the data from the second IMU 72 (e.g., second IMU data 90) to correct the acceleration data (e.g., 82, 84, 86, 92, 94, 96) and the rotation data (e.g., 83, 85, 87, 93, 95, 97) to use corrected, and thereby more accurate, data for calculating the motion, the velocity, and the path traveled by the head 30 of the golf club 20.

Magnetic field data from either the first IMU 60 (e.g., 88) and/or the second IMU 72 (e.g., 98) may be used to identify the time at or near impact (e.g., 89, 99) of the golf head 30 with the golf ball 19. The magnetic field data from the first IMU 60 may be used to correct the magnetic field data from the second IMU 72 or vice a versa. However, the reading from the magnetometer of the first IMU 60 and/or the second IMU 72 is essentially a pulse of short duration. As best seen in FIG. 17, the swing of the golf club 20 takes the head 30, and thereby the magnetometer 69, close to a magnet that is adapted to be positioned proximate to the golf ball 19 so that the maximum magnetic field strength read by the magnetometer occurs at or near the impact of the head 30 with the golf ball 19. Since magnetic field strength is inversely proportional to the square of the distance between the magnetometer and the magnet, the magnetic field strength measured by the magnetometer increases rapidly as the magnetometer approaches the magnet and drops off just as rapidly as the magnetometer swings past the magnet. In other words, detecting the maximum magnetic field strength, and therefore the time at or near the impact of the golf had 30 with the golf ball 19, is fairly accurate.

In an example embodiment, only the first IMU 60 includes the magnetometer 69, so the magnetic field data 88 is not corrected. In an example embodiment, the first IMU 60 and the second IMU 70 include a respective magnetometer 69. The magnetic field data (e.g., 88) from the first IMU 60 or the magnetic field data (e.g., 98) is used to determine the time at or near impact (e.g., 89 or 99).

The process of using the acceleration data (e.g., 82, 84, 86, 92, 94, 96) and the rotation data (e.g., 83, 85, 87, 93, 95, 97) from the first IMU 60 and the second IMU 72 to determine the corrected acceleration data and the corrected rotation data may be performed by the processing circuit 52, the server 110, the mobile computer 112 and/or smart phone 114. The second embodiment of the motion capture system, the motion capture system 70, captures the data used to generate the corrected acceleration and rotation data.

In an example embodiment, the processing circuit 52 uses the acceleration data of the first IMU 60 (e.g., 82, 84, 86) and the acceleration data of the second IMU 72 (e.g., 92, 94, 96) to determine the corrected acceleration data. The processing circuit 52 uses the rotation data of the first IMU 60 (e.g., 83, 85, 87) and the rotation data of the second IMU 72 (e.g., 93, 95, 97) to determine the corrected rotation data. The processing circuit 52 uses the corrected acceleration data and the corrected rotation data to determine the velocity of the head 30 and/or an orientation of the face 33. In an example embodiment, the processing circuit 52 uses the corrected acceleration data and the corrected rotation data to determine the velocity of the head 30 and/or the orientation of the face 33 at the time at or near the impact (e.g., 89, 99). In an implementation, the processing circuit 52 uses the corrected acceleration data and the corrected rotation data to further determine the path of travel of the head 30, and in particular, to determine the path of travel of the head 30 at the time at or near the impact (e.g., 89, 99).

In an example embodiment, the processing circuit 52 uses the acceleration data of the first IMU 60 (e.g., 82, 84, 86) and the acceleration data of the second IMU 72 (e.g., 92, 94, 96) to determine the corrected acceleration data, and the rotation data of the first IMU 60 (e.g., 83, 85, 87) and the rotation data of the second IMU 72 (e.g., 93, 95, 97) to determine the corrected rotation data. The communication circuit 54 transmits the corrected acceleration data, the corrected rotation data and the magnetic field data to the server 110 and/or a computing device (e.g., 112 or 114).

In an example embodiment, the computing device (e.g., 112, 114) is adapted to correct the acceleration data of the first IMU 60 (e.g., 82, 84, 86), the acceleration data of the second IMU 72 (e.g., 92, 94, 96), the rotation data of the first IMU 60 (e.g., 83, 85, 87) and the rotation data of the second IMU 72 (e.g., 93, 95, 97) to correct for at least one of a bias error, an offset error, a drift error, a non-linear error, and alignment error, a zero-g bias error, cross-axis sensitivity, noise, and/or noise density.

In an example embodiment, the computing device (e.g., 112, 114) is adapted to use sensor fusion techniques to correct the acceleration data of the first IMU 60 (e.g., 82, 84, 86), the acceleration data of the second IMU 72 (e.g., 92, 94, 96), the rotation data of the first IMU 60 (e.g., 83, 85, 87) and the rotation data of the second IMU 72 (e.g., 93, 95, 97) to generate the corrected acceleration data and/or the corrected rotation data.

In an example embodiment, the processing circuit 52 may transmit the corrected acceleration data and/or the corrected rotation data, and/or data regarding the velocity of the head 30, the orientation of the face 33 and/or the path of travel of the head 30 to the server 110 and/or a computing device (e.g., 112, 114) to present the data on the display (e.g., 113, 115) for viewing by the user. The mobile computer 112 may present the data on display 113. Smart phone 114 may present the data on display 115.

In an example embodiment, the processing circuit 52 determines the corrected acceleration and rotation data. The processing circuit 52, via the communication circuit 54, transmits the corrected acceleration data, the corrected rotation data, and the magnetic field data to the server 110 and/or the computing device (e.g., 112, 114). The server 110 and/or the computing device (e.g., 112, 114) uses the corrected acceleration data and/or the corrected rotation data to determine the velocity of the head 30, an orientation of the face 33, and/or the path of travel of the head 30, including at the time at or near the impact (e.g., 89, 99).

In an example embodiment, the communication circuit 54 transmits the acceleration data of the first IMU 60 (e.g., 82, 84, 86), the acceleration data of the second IMU 72 (e.g., 92, 94, 96) and rotation data of the first IMU 60 (e.g., 83, 85, 87) and/or the rotation data of the second IMU 72 (e.g., 93, 95, 97) to the computing device (e.g., 112 or 114). The computing device (e.g., 112 or 114) is adapted to use the acceleration data from the first IMU 60 and the second IMU 72 (e.g., 82, 84, 86, 92, 94, 96) to determine the corrected acceleration data and the rotation data from the first IMU 60 and the second IMU (e.g., 83, 85, 87, 93, 95, 97) to determine the corrected rotation data. The computing device is adapted to use the corrected acceleration data, the corrected rotation data and the magnetic field data (e.g., 88, 98) to determine the corrected velocity of the head 30 and the corrected orientation of the face 33 at the time at or near the impact (e.g., 89, 99). The computing device (e.g., 112 or 114) is adapted to present the corrected velocity and the corrected orientation on the display (e.g., 113 or 115) for viewing by the user.

In an example embodiment, the computing device (e.g., 112 or 114) is further adapted to use the corrected acceleration data, the corrected rotation data and the magnetic field data (e.g., 88, 98) to determine the path of travel of the head 30 at the time at or near impact (e.g., 89, 99).

In the corrected acceleration and rotation data, the velocity of the head 30, especially at the time at or near impact 89, depends primarily on corrected acceleration data along the face-axis 34 (e.g., corrected version of face-axis linear acceleration data 82 and the face-axis linear acceleration data 92) for the same reasons discussed above. The corrected acceleration data along all axes (e.g., hosel-axis 32, hosel-axis 34, z-axis) may be used to determine the path of travel of the head 30. The orientation of the face 33, especially at the time at or near impact 89, depends primarily on the corrected rotation data around the hosel-axis 32 (e.g., corrected version of the hosel-axis rotation data 85 and the hosel-axis rotation data 95) also for the same reasons discussed above.

H. Capture Rate

In an implementation, the first IMU 60 and the second IMU 72 provide data output as digital data. The IMU detects the acceleration, the rotation, and the magnetic field as a continuous, analog value, but samples (e.g., captures) the analog value periodically to provide a digital number that represents the sampled analog value. The sampling period (e.g., time between samples) may be expressed as a frequency. For example, the sampling period may be 3600 Hz, which means the analog values of the acceleration, the rotation, and the magnetic field are sampled 3,600 times per second. So, each second 3,600 digital numbers are provided by the IMU for the acceleration, the rotation, and the magnetic field respectively as measured by the IMU.

The IMU may sample the data for the acceleration, the rotation and the magnetic field at the same time, so the data provided by IMU for the acceleration, the rotation and the magnetic field all have the same time base. That means that the data captured at a particular time (e.g., 1 second, 2 second, 3 second, so forth) in one data set (e.g., acceleration, rotation, magnetic field) relates to the data captured in the other data sets at that particular time. A common time base means that when the magnetometer of the IMU detects the maximum magnetic field strength, the acceleration data and the rotation data measured at the same time was also measured at the time at or near impact.

In an example embodiment, first IMU 60 captures the acceleration data (e.g., 82, 84, 86), the rotation data (e.g., 83, 85, 87) and the magnetic field data (e.g., 88) at a sampling rate of at least 1600 Hz. The time at or near the impact is common to the acceleration data, the rotation data and magnetic field data of the first IMU 60.

In an example embodiment, the first IMU 60 captures data at a first sampling rate of at least 1600 Hz. The second IMU 72 captures data independent of the first IMU 60 at a second sampling rate of at least 1600 Hz. The first sampling rate and the second sampling rate provide a combined sampling rate of at least 3200 Hz. The time at or near the impact is common to the acceleration data and the rotation data captured by the first IMU 60 and the second IMU 72, and the magnetic field data captured by the first IMU 60 and/or the second IMU 72.

For example, assume that the first sampling rate and the second sampling rate is 1600 Hz, which means that the first IMU 60 samples the acceleration (e.g., 82, 84, 86), rotation (e.g., 83, 85, 87) and magnetic field (e.g., 88) data 1,600 times per second thereby capturing 1,600 digital data values per second. The second IMU 72 independently captures an additional 1,600 digital data values per second for its acceleration (e.g., 92, 94, 96), rotation (e.g., 93, 95, 97) and magnetic field (e.g., 98) data. The combined sampling rate of the first IMU 60 and the second IMU 72 is 3,200 samples per second.

In an example embodiment, the second sampling rate is the first sampling rate with an offset from the first sampling rate of a half of a period of the first sampling rate. In this example embodiment, the first IMU 60 and the second IMU 72 capture data at the same rate, but their time of capture is staggered (e.g., offset). For example, if the sampling period is T, then the first IMU 60 would capture data at the time=0*T, 1*T, 2*T, and so forth, while the second IMU 72 would capture data at the time=0.5*T, 1.5*T, 2.5*T, and so forth. The offset need not be half of the period of sample. The offset could be any portion of the period, so long as the first IMU 60 and the second IMU 72 are not sampling at the same time.

In another example, assume that the sampling rate for the first IMU 60 and the second IMU 72 is 1600 Hz, which means that the first IMU 60 and the second IMU 72 each independently capture acceleration (e.g., 82, 84, 86, 92, 94, 96), rotation (e.g., 83, 85, 87, 93, 95, 97) and magnetic field (e.g., 88, 98) data every 625 microseconds. Since the first IMU 60 and the second IMU 72 capture data at the same time, their capture times may be staggered (e.g., offset) so that the first IMU 60 captures data at the time=0, 1×625 microseconds, 2×625 microseconds, 3×635 microseconds, and so forth while the second IMU 72 captures data at the time=0.5×625 microseconds, 1.5×635 microseconds, 2.5×625 microseconds, and so forth.

Staggering the capture time of the first IMU 60 and the second IMU 72 provides a more complete picture of the acceleration, rotation and magnetic field that act on the head 30 of the golf club 20. Staggering the capture time provides a more complete picture of the acceleration, rotation and magnetic field. More frequent and better distributed samples increase the accuracy of the data being captured.

Figure 15:
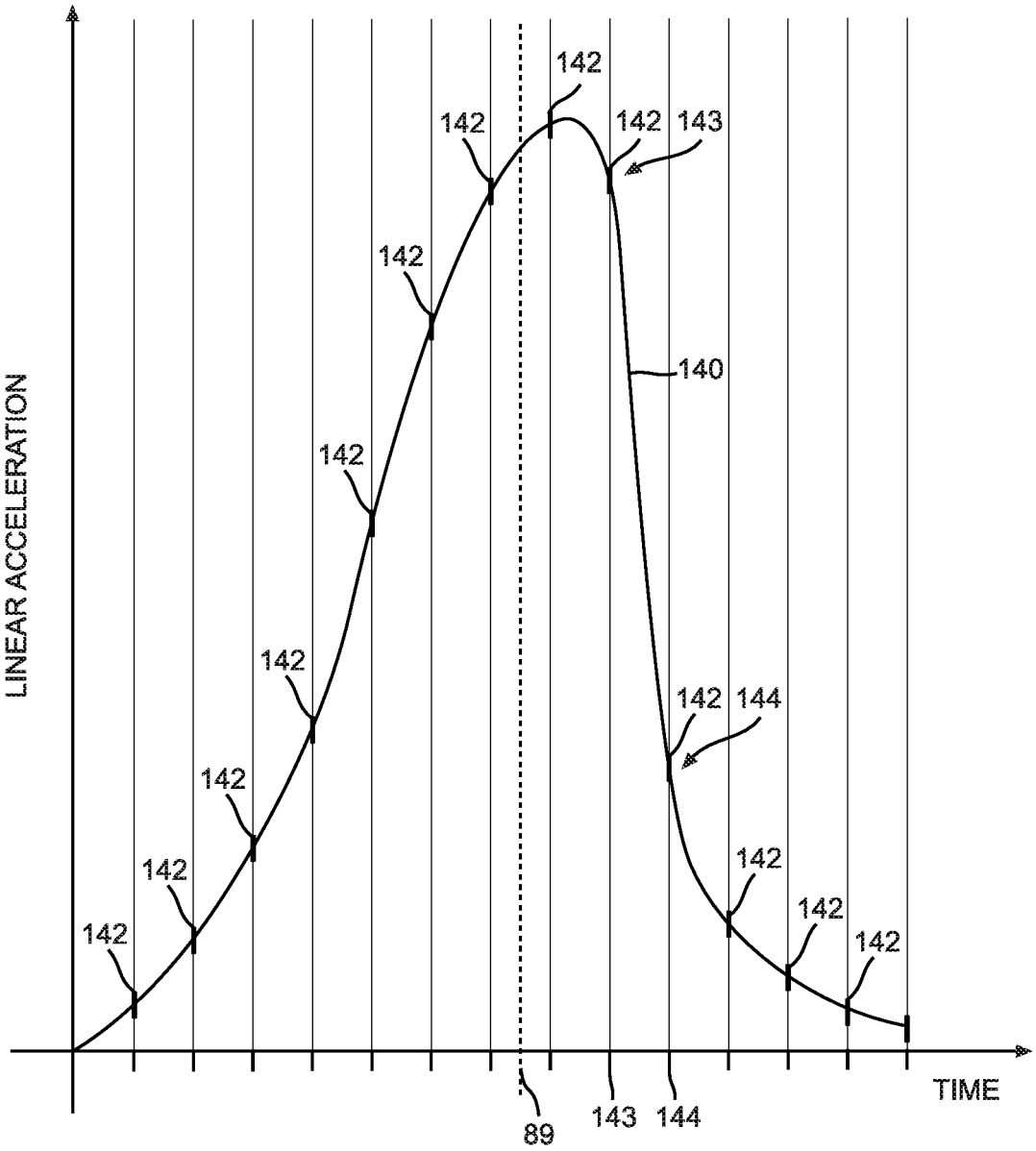
FIG. 15 is a diagram of an example embodiment of data sampling performed by the first IMU.

For example, referring to FIG. 15, each sample captured by the first IMU 60 of the face-axis acceleration 140 is shown by a vertical line 142. Not all of the vertical lines 142 are marked in FIG. 15; however, each vertical line drawn on the face-axis acceleration 140 represents the time at which the first IMU 60 captures a sample. Note that between the time 143 and the time 144, no samples were captured because the rate of change of the face-axis acceleration 140 is too fast.

If the period of capture of the second IMU 70 where the same as the period of capture of the first IMU 60, with no offset, the second IMU 70 would capture data at each vertical line 142 just like the first IMU 60. With no offset, no samples are captured by either the first IMU 60 or the second IMU 70 between the time 143 and the time 144.

Figure 16:
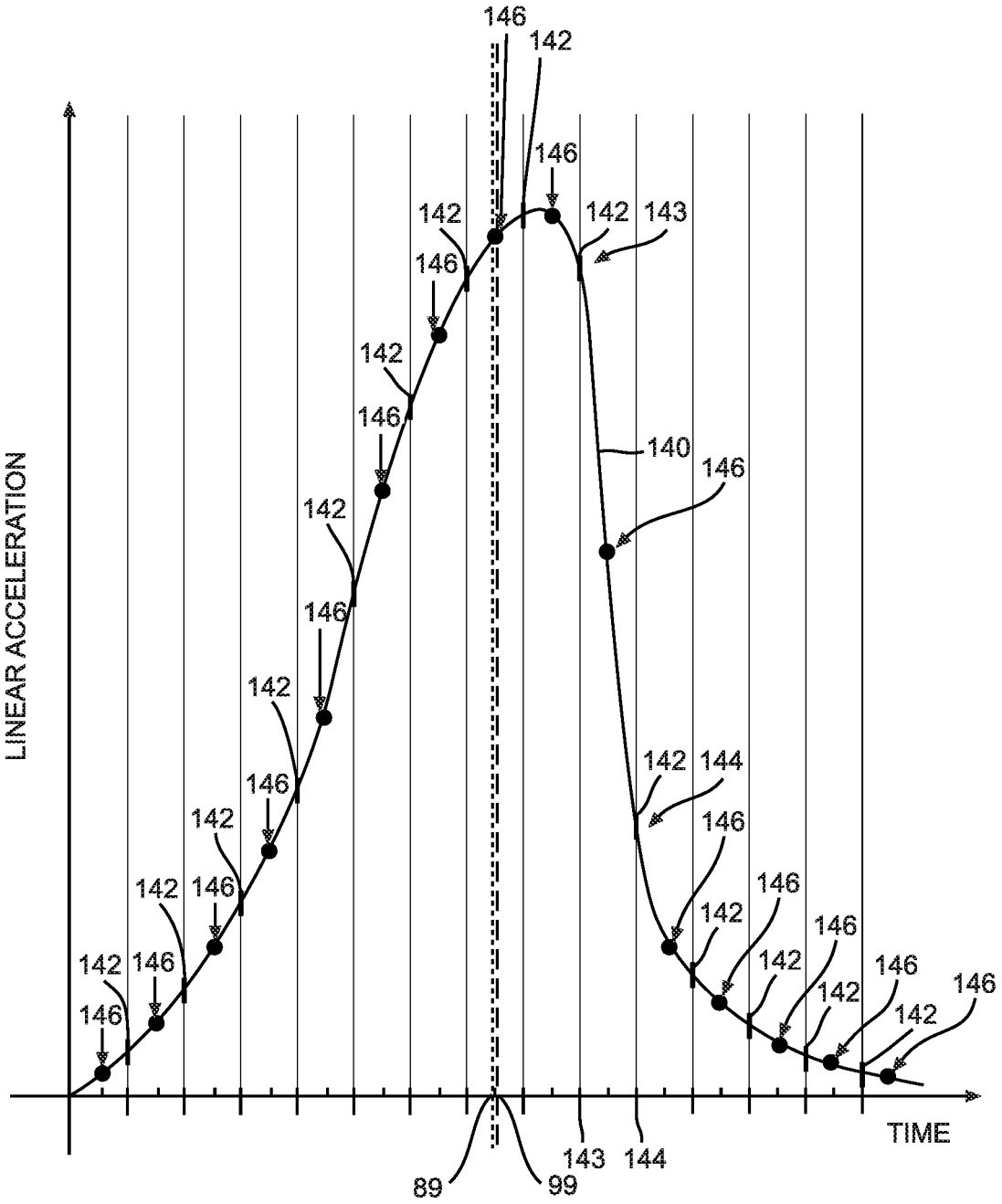
FIG. 16 is a diagram of an example embodiment of data sampling performed by the first IMU and the second IMU.

The combined and staggered sampling times of the first IMU 60 and the second IMU 72 are shown in FIG. 16. The vertical lines 142 on the face-axis acceleration 140 represent the sample times of the first IMU 60 as discussed above. The dots, indicated by the arrows 146, on the face-axis acceleration 140, represent the sample times of the second IMU 72. Not all arrows 146 are marked. The first IMU 60 samples the face-axis acceleration 140 at the same rate as the second IMU 72. However, the vertical lines 142 of the first IMU 60 are offset from the arrows 146 of the second IMU 72 by half the period of the sample time. Because the first IMU 60 does not sample the face-axis acceleration 140 at the same time as the second IMU 72, the combined samples more accurately represent the face-axis acceleration 140 because more samples are taken at different times. Further, between the time 143 and the time 144, the second IMU 72 captures a sample thereby providing a more accurate picture of the rapid change in the face-axis acceleration 140.

I. Mat

The mat 40 provides a reference for a golf swing. The mat 40 may include markings, visible to user, such as the centerline 42 along a length of the mat 40. The centerline 42 provides the user a reference for a straight shot swing of the golf club 20. The centerline 42 may be oriented along the desired direction of travel. In other words, the centerline may be pointed down the fairway toward the flag. The centerline 42 provides a reference for orienting the flat portion of the head 30 of the golf club 20 perpendicular to the desired direction of travel of the golf ball 19. Orienting the flat portion of the face 33 perpendicular to the centerline 42 orients the flat portion of the face 33 perpendicular to the desired direction of travel and perpendicular to the golf ball 19. If the flat portion of the face 33 is perpendicular to the desired direction of travel of the golf ball 19, when the face 33 strikes (e.g., impacts) the golf ball 19, the golf ball 19 will travel along the desired direction of travel.

The mat 40 may be adapted to receive the tee 46 that holds the golf ball 19. The mat 40 be adapted to position the tee 46 in the same place each time to provide a consistent platform for hitting the golf ball 19. In an example embodiment, the mat 40 includes a hole for receiving the tee 46. The hole is positioned along the centerline 42. So, orienting the flat portion of the face 33 perpendicular to the centerline 42 positions the flat portion of the face 33 perpendicular to the golf ball 19.

The magnet 44 may also be adapted to be positioned on the mat 40. The magnet 44 may be adapted to be positioned proximate to the golf ball 19 and/or the tee 46. The mat 40 and/or the magnet 44 may include structures for consistent placement of the magnet 44 with respect to the golf ball 19 and/or the tee 46. As discussed above, placing the magnet proximate to the golf ball 19 and/or the tee 46 enables the magnetometer of the first IMU 60 and/or the second IMU 72 to detect a maximum magnetic field strength at or near the time of impact of the head 30 of the golf club 20 with the golf ball 19.

An example golf swing that brings the motion capture system 50, and therefore the magnetometer 69, proximate to the magnet 44 at or near impact of the head 30 with the golf ball 19 is shown in FIG. 17. At the beginning of the downstroke, the far-left image of the golf club 20, the motion capture system 50 is distant from the magnet 44, so the magnetometer of the first IMU 60 and/or the second IMU 72 does not detect the magnetic field from the magnet 44. As the head 30 swings closer to the magnet 44, the magnetometer 69 begins to detect the magnetic field from the magnet 44. When the head 30 of the golf club 20 is positioned directly over the magnet 44, the magnetometer 69 of the motion capture system 50 captures the maximum magnetic field strength which coincides with the time at or near impact 89.

As a golf swing continues, the head 30 of the golf club 20 moves past the magnet 44. As the head 30 moves past the magnet 44, the strength of the magnetic field detected by the magnetometer 69 of the motion capture system 50 decreases rapidly, so the time of detecting the maximum magnetic field strength accurately represent the time at or near impact of the head 30 with the golf ball 19.

Accordingly, in an example embodiment, at or near the impact of the head 30 with a golf ball 19, the magnet 44 is adapted to be positioned proximate to the first IMU 60 and/or the second IMU 72 of the motion capture system 50. The magnet 44 may be adapted to be positioned on or in the mat 40, proximate to the tee 46 with or without the mat 40, and/or proximate to the golf ball 19 with or without the mat 40 or the tee 46. The magnet 44 may be adapted to be positioned along the desired direction of travel of the golf ball 19. In an embodiment, the magnet 44 is adapted to be positioned along the centerline 42 of the mat 40. In an example embodiment, the magnet 44 is adapted to be positioned in the golf ball 19.

In another example embodiment, the magnet 44 has an O-shape. The tee 46 is adapted to be positioned through the center of the O-shape of the magnet 44. The tee 46 is adapted to hold the golf ball 19 to thereby position the magnet 44 proximate to the golf ball 19 so that the magnet 44 is proximate to the first IMU 60 and/or the second IMU 72 at or near impact of the head 30 with the golf ball 19. In another example embodiment, the magnet 44 has an O-shape and is positioned on or is embedded in the mat 40. The tee 46 is adapted to be positioned through the hole of the O-shape of the magnet 44. The tee 46 may be further positioned in a hole in the mat 40 that is aligned with the hole of the O-shape of the magnet 44. The magnet 44 and the hole in the mat 40 are positioned along the centerline 42.

The mat 40 may be formed of any material suitable for positioning on the ground. The mat 40 may be formed of a material that is flexible, inflexible or a combination thereof. The mat 40 may be of any thickness. The centerline 42 may be on (e.g., paint, sticker) the upper surface of the mat 40. The centerline 42 may be embedded, at least partially, in the upper surface of the mat 40. The centerline 42 may be illuminated.

J. LED System

The head 30 of the golf club 20 may include an LED system 100. The LED system may include the first LED 102, the second LED 104, the power supply 106, the processing circuit 107 and the communication circuit 108. The power supply 106 provides power to the first LED 102, the second LED 104, the processing circuit 107 and the communication circuit 108 so that they may function. The processing circuit 107 controls the operation of the communication circuit 108, the first LED 102 and the second LED 104. The processing circuit 107 may control the illumination (e.g., duration, intensity, on time, off time, period of on-time and off time, flash, color) of the first LED 102 and the second LED 104. The processing circuit 107 may receive instructions via the communication circuit 108 from a user. A user may transmit instructions to the LED system 100 using a computing device (e.g., 112, 114). The user may instruct (e.g., control) the processing circuit 107 on how to illuminate the first LED 102 and the second LED 104.

In an example embodiment, the functions performed by the power supply 106, the processing circuit 107 and the communication circuit 108 may be performed by the power supply 56, the processing circuit 52 and the communication circuit 54. In other words, the LED system 100 may be integrated into (e.g., combined with) the motion capture system 50 or the motion capture system 70.

The first LED 102 and the second LED 104 are positioned at least partially on the top of the head 30 so that the light from the first LED 102 and the second LED 104 is visible to the user, including while the user swings the golf club 20. In an example implementation, the LED system 100 is used in combination with the mat 40 and with the centerline 42 of the mat 40.

Figure 20:
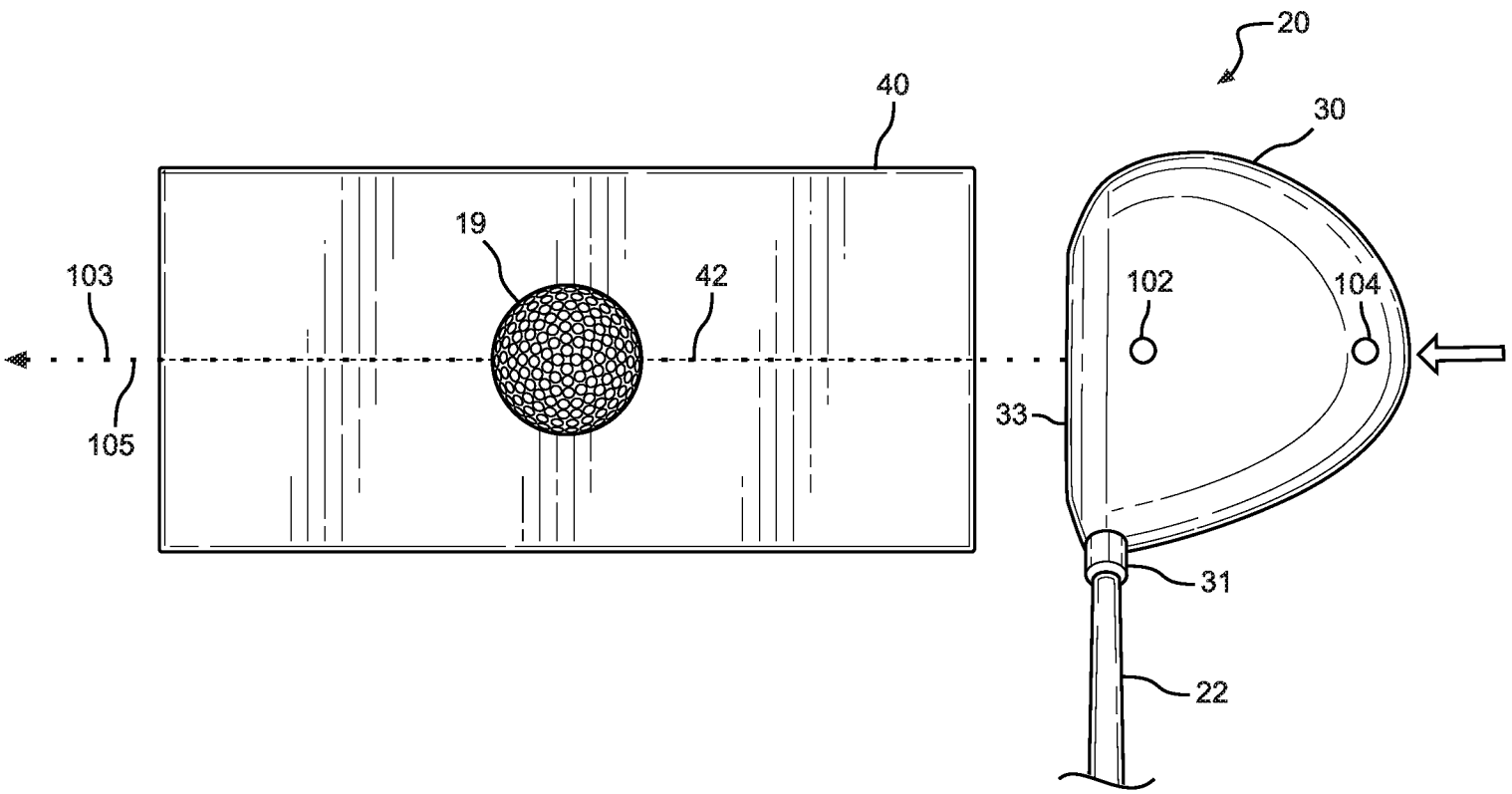
FIG. 20 is a diagram of the golf club with the example embodiment of the LED system and a top view of the mat during a straight shot.
Figure 21:
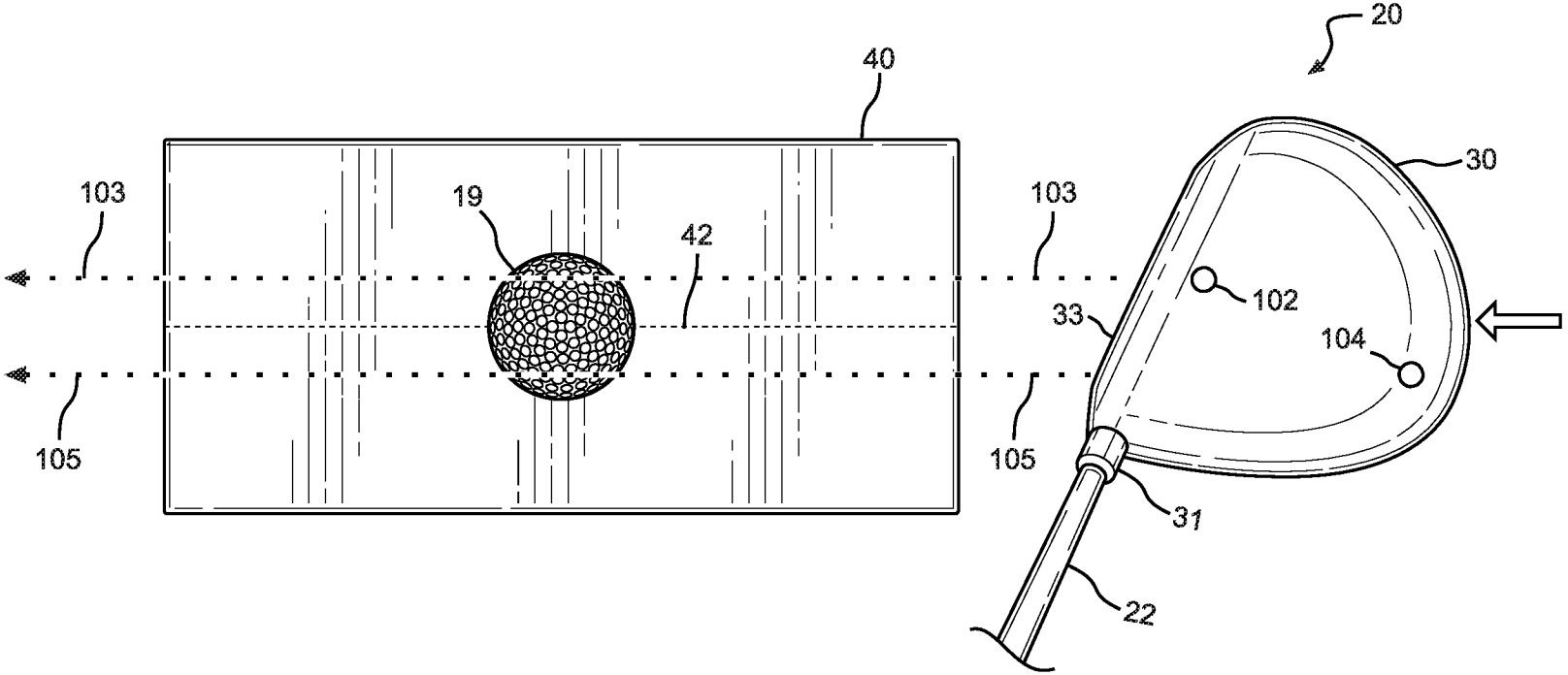
FIG. 21 is a diagram of the golf club with the example embodiment of the LED system and a top view of the mat during a slice shot.
Figure 22:
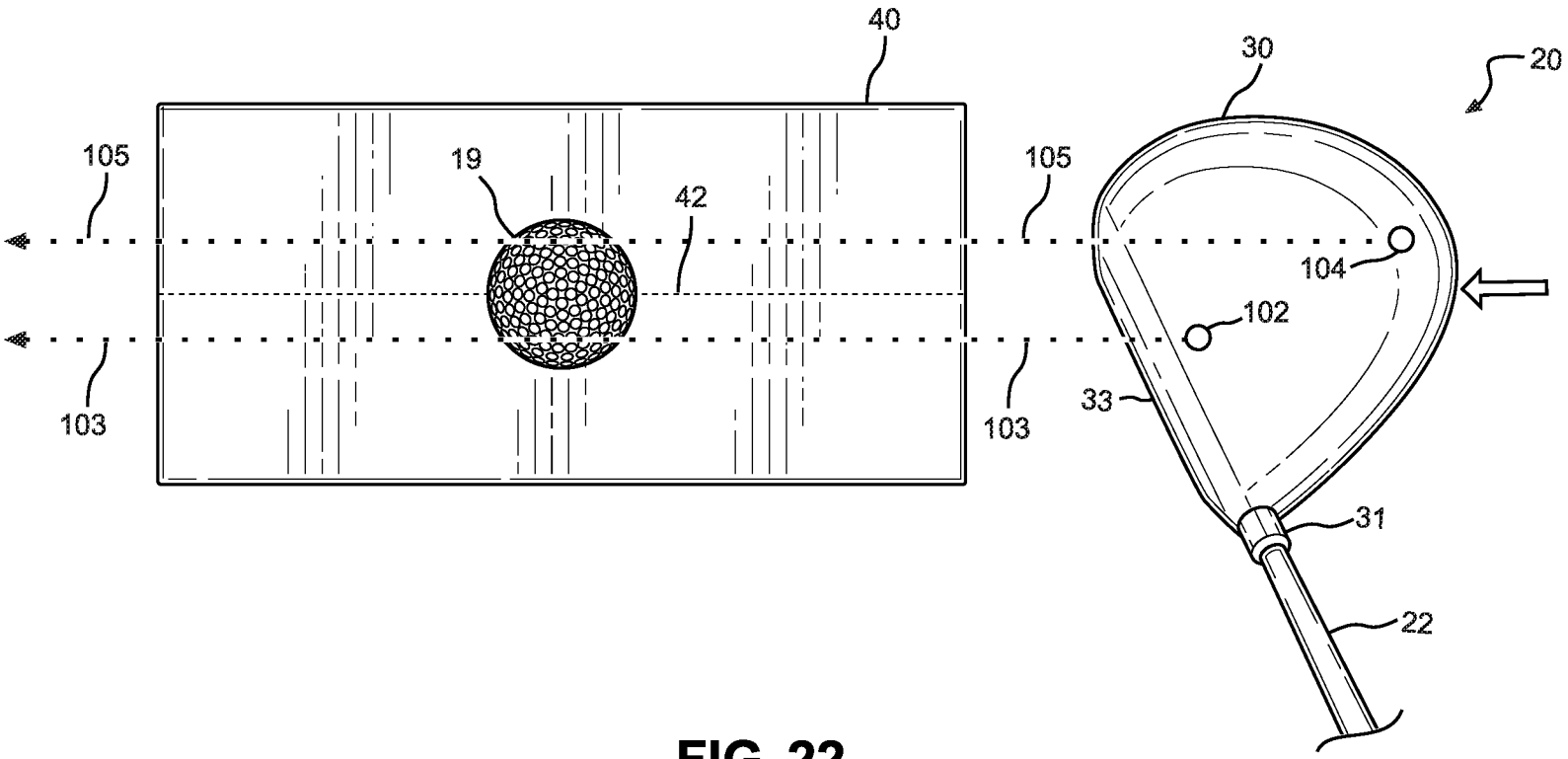
FIG. 22 is a diagram of the golf club with the example embodiment of the LED system and a top view of the mat during a hook shot.

In an example embodiment, the mat 40 has the centerline 42 visible along the length of the mat 40. The head 30 of the golf club 20 includes the first LED 102, the second LED 104 and a sweet spot 36 on the face 33. The first LED 102 and the second LED 104 are positioned on a top portion (e.g., surface) of the head 30 along an axis that is perpendicular to the flat portion of the face 33 and in-line with the sweet spot 36. The light from the first LED 102 and the light from the second LED 104 provide a visual cue to the user regarding the path of travel of the head 30 relative to the centerline 42 of the mat 40. For example, as best shown in FIGS. 20-22, the mat 40 has centerline 42. The golf ball 19 is placed along the centerline 42. The centerline 42 is oriented along the desired direction of travel of the golf ball 19. Generally, during the swing, the user is looking at the golf ball 19, so they can also see the light from the first LED 102 and the second LED 104 as the head 30 swings toward and then past the golf ball 19.

As discussed above, the first LED 102 and the second LED 104 are positioned along the line (e.g., axis) that is perpendicular to the flat portion the face 33. So, during the swing of the golf club 20, while a path 103 of the light from the first LED 102 and a path 105 of the light from the second LED 104 are parallel to the centerline 42, the flat portion of the face 33 is oriented perpendicular to the centerline 42. Further, during the swing of the golf club 20, while a path 103 of the light from the first LED 102 and a path 105 of the light from the second LED 104 are parallel to the centerline 42 at the time at or near the impact of the head 30 with the golf ball 19, the flat portion of the face 33 is oriented perpendicular to the centerline 42 at the time at or near the impact of the head 30 with the golf ball 19.

Just because the path 103 of light from the first LED 102 and the path 105 of the light from the second LED 104 are parallel to the centerline 42 does not mean that the sweet spot 36 will strike the golf ball 19. Referring to FIG. 20, the first LED 102 and the second LED 104 are not only moving parallel to the centerline 42, but the path 103 of the first LED 102 and the path 105 of the second LED 104 are also in line with the centerline 42, so the flat portion of the face 33 is perpendicular to the centerline 42 and the sweet spot is in line with, and will strike, the golf ball 19. However, the paths 103 and 105 may be parallel to the centerline 42, but be above or below the centerline 42, so even though the flat portion of the face 33 is parallel to the centerline 42, the sweet spot 36 will not strike the golf ball 19. But in any case, whether aligned with the centerline 42 or not, during the swing of the golf club 20, while the path 103 of the light of the first LED 102 and the path of the light of the second LED 104 are parallel to the centerline 42, the flat portion of the face 33 is oriented perpendicular to the centerline 42 at the time at or near the impact of the head 30 with the golf ball 19.

The light from the LEDs also makes it possible for a user to see when the flat portion of the face 33 is not perpendicular to the centerline 42. In FIG. 21, the swing of the golf club 20 is a slice shot and the flat portion of the face 33 is not perpendicular to the centerline 42. As the user swings, the user can see that the path 103 of the light from the first LED 102 is above the centerline 42, while the path 105 of the light from the second LED 104 is below the centerline 42. The first and the second LEDs 102 and 104 may provide light of different colors to help distinguish the paths (e.g., arcs) they travel. In FIG. 22, the swing of the golf club 20 is a severe hook shot. As the user swings, the user can see that the path 105 of the light from the second LED 104 is above the centerline 42, while the path 103 of the light from the first LED 102 is below the centerline 42.

K. Server, Network, Computing Device

As discussed above, a golf swing analyzer system may include server 110, network 116, and one or more computing devices (e.g., 112, 114). As further discussed above, the server 110 and/or the one or more computing devices (e.g., 112, 114) may receive captured data from the golf club 20 regarding the swing of the golf club 20 for presentation to the user. The server 110 and/or the one or more computing devices (e.g., 112, 114) may include a processing circuit for performing calculations on the captured data from the golf club 20 to prepare the data for presentation.

The computing devices (e.g., 112, 114) include displays (e.g., 113, 115) for presenting the data regarding the swing of the golf club 20 to the user. The server 110 may or may not include a display. The server 110 may receive the data from the golf club 20, prepare the data for presentation and send the prepared data to one or more of the computing devices (e.g., 112, 114) for presentation on their displays (e.g., 113, 115).

In an example embodiment, the computing device (e.g., 112, 114) has a display (e.g., 113, 115). The communication circuit 54 of the motion capture system (e.g., 50, 70) transmits the acceleration data (82, 84, 86 and/or 92, 94, 96), the rotation data (e.g., 83, 85, 87 and/or 93, 95, 97) and the magnetic field data (e.g., 88 and/or 98) to the computing device (e.g., 112, 114). The computing device is adapted to use the acceleration data (82, 84, 86 and/or 92, 94, 96), the rotation data (e.g., 83, 85, 87 and/or 93, 95, 97) and the magnetic field data (e.g., 88 and/or 98) to determine the velocity of the head 30 and/or the orientation of the face 33 at the time at or near the impact (e.g., 89 and/or 99). The computing device (e.g., 112, 114) is adapted to present the velocity and/or the orientation on the display (e.g., 113, 115) for viewing by a user. In another example embodiment, the computing device (e.g., 112, 114) is adapted to use the acceleration data (82, 84, 86 and/or 92, 94, 96), the rotation data (e.g., 83, 85, 87 and/or 93, 95, 97) and the magnetic field data (e.g., 88 and/or 98) to determine the path of travel of the head 30 at the time at or near the impact (e.g., 89 and/or 99) and to present the path of travel on the display (e.g., 113, 115) for viewing by the user.

As discussed above, the first IMU data 80 and the second IMU data 90 may be used to generate corrected acceleration data and corrected rotation data. The corrected data may be used to determine the velocity of the head 30, the orientation of the face 33 and/or the path of travel of the head 30. In an example embodiment, the computing device (e.g., 112, 114) is adapted to use the corrected acceleration data, the corrected rotation data and the magnetic field data (e.g., 88 and/or 98) to determine the velocity of the head 30, the orientation of the face 33 and/or the path of travel of the head 30 at the time at or near impact (e.g., 89 and/or 99). The computing device (e.g., 112, 114) is adapted to present the velocity, the orientation and/or the path of travel on the display (e.g., 113, 115) for viewing by the user.

L. Example Methods

In use, the golf swing analyzer system collects data (e.g., acceleration, rotation, magnetic field) regarding the swing of the golf club 20. The data is analyzed to determine the velocity of the head 30, the orientation of the face 33, including the flat portion of the face 33, and the path of travel of the head 30. The velocity of the head 30, the orientation of the face 33 and the path of travel may all be referenced to the time at or near impact of the head 30 with the golf ball 19. The movement of the head 30, along with the velocity, the orientation and the path of travel may be presented to the user on a display. The user may use information presented on the display to identify areas for improvement of their swing.

As a user swings the golf club 20, the user may also visualize the swing with respect to the centerline 42 of the mat 40 with the aid of the light from the first LED 102 and the second LED 104. The light from the first LED 102 and the second LED 104, especially with respect to the centerline 42, can inform the user whether the head 30 of the golf club 20 was in line with the golf ball 19 prior to impact and whether the flat portion the face 33 of the head 30 was perpendicular to the desired direction of travel of the golf ball 19.

Figure 23:
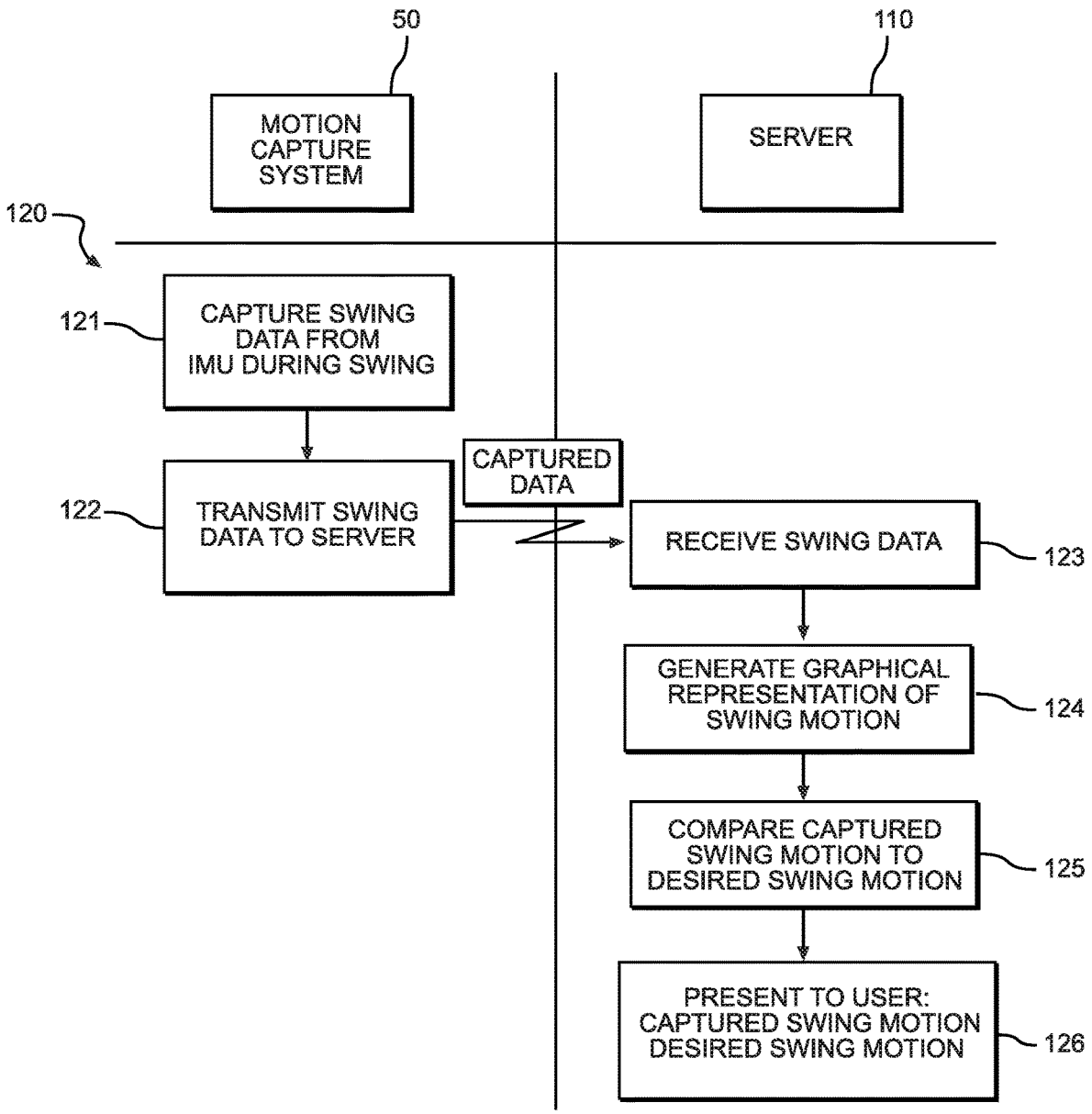
FIG. 23 is a flowchart of a first example method for preparing data for presentation to user.
Figure 24:
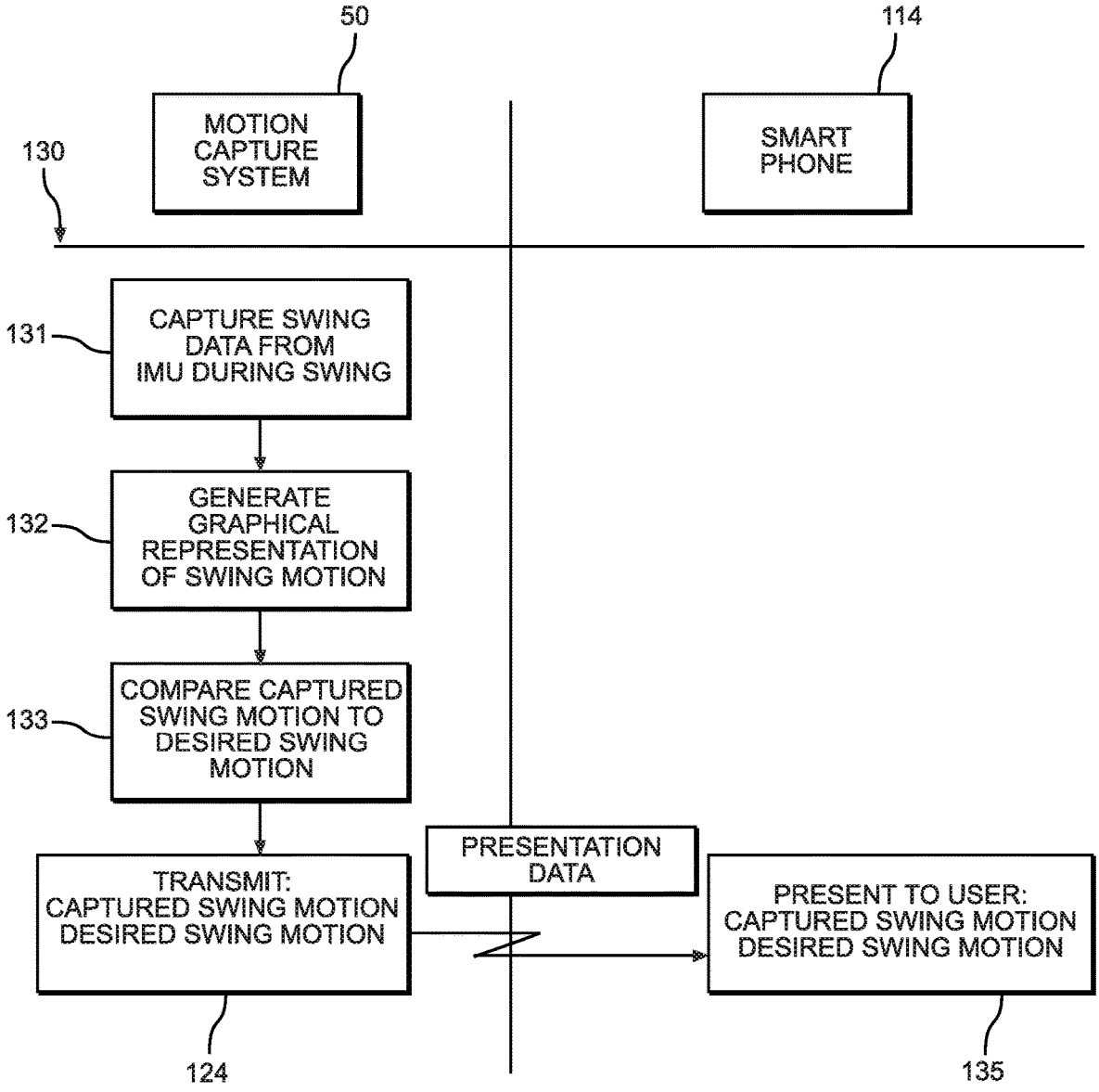
FIG. 24 is a flowchart of a second example method for preparing data for presentation to user.

The motion capture system (e.g., 50, 70) may cooperate with the server 110 and/or one or more computing devices (e.g., 112, 114) to collect the data, analyze the data and present the data regarding the movement of the golf club 20. In an example method 120, as best shown in FIG. 23, the motion capture system (e.g., 50, 70) captures the data (e.g., 80, 90) regarding the swing of the golf club 20 and transmits the data to the server 110 to perform calculations and to present the data. In another example method 130, as best shown in FIG. 24, the motion capture system (e.g., 50, 70) captures the data (e.g., 80, 90) regarding the swing of the golf club 20, performs calculations to prepare the data for presentation and transmits the data to the smart phone 114 for presentation to the user on the display 115.

The example method 120 includes a capture step 121, a transmit step 122, a receive step 123, a generate step 124, a compare step 125 and a present step 126.

In the capture step 121, the motion capture system (e.g., 50, 70) captures data during the swing of the golf club 20. The motion capture system 50 uses the first IMU 60 to capture the first IMU data 80 which includes acceleration data (e.g., 82, 84, 86), rotation data (e.g., 83, 85, 87) and magnetic field data (e.g., 88). The motion capture system 70 uses the first IMU 60 and the second IMU 72 to capture the first IMU data 80 and the second IMU data 90 which includes acceleration data (e.g., 82, 84, 86, 92, 94, 96), rotation data (e.g., 83, 85, 87, 93, 95, 97) and magnetic field data (e.g., 88 and/or 98).

In the transmit step 122, the communication circuit 54 of the motion capture system (e.g., 50, 70) transmits the captured data (e.g., 80, 90) to the server 110. The communication circuit 54 may transfer the captured data via a wired or wireless communication link.

In the receive step 123, the server 110 receives the captured data. As discussed above, the captured data may be transmitted to the server 110 over a wired and/or a wireless communication link. In the example method 120, captured data (e.g., 80, 90) is transmitted from the motion capture system (e.g., 50, 70) by the communications circuit 54 to the server 110 via a wireless communication link. The wireless communication link may allow communication directly with the server 110 or communication with the server 110 via the network 116.

In the generate step 124, the server 110 generates a graphical representation of the swing motion of the golf club 20. Generating a graphical representation of the swing motion of the golf club 20 may include generating corrected acceleration and corrected rotation data as discussed above. The server 110 may use the magnetic field data (e.g., 88 and/or 89) to determine the time at or near the impact (e.g., 89 and/or 99) of the head 30 with the golf ball 19. Among other things, the server 110 may use captured data to determine the velocity of the head 30, the orientation of the face 33 and/or the path of travel of the head 30. The server 110 may use captured data to determine the velocity of the head 30, the orientation of the face 33 and the path of travel of the head 30 during all portions of the swing and/or at the time at or near impact.

In the compare step 125, the server 110 compares the captured data and/or the calculated data to a desired swing motion. The server 110 may compare the velocity of the head 30, the orientation of the face 33 and/or the path of travel of the head 30 to information regarding the velocity, the orientation and/or the path of travel needed to send golf ball 19 down the intended fairway to the flag. The server 110 may compare the velocity, the orientation and/or the path of travel at the time at or near impact of the head with golf ball 19 with information regarding the desired velocity, orientation and/or path of travel at the time at or near impact.

In the present step 126, the server 110 presents the captured data, the calculated velocity, orientation and/or path of travel to the user on a display. The server 110 may further present the desired velocity, orientation and/or path of travel for visual comparison by the user. The server 110 may present the data to the user as a motion video and/or as still photographs. The presentation may include sound and/or sound effects. The sound effects may be related to the velocity, orientation and/or path of travel of the head 30.

The video may be overlaid with information such as the orientation of the flat portion of the face 33 with respect to the golf ball 19 and/or the centerline 42 of the mat 40. The overlaid information may include a numerical representation of the speed (e.g., velocity) of the head 30 of the golf club 20, a colored line along the arc of the head 30 during the swing, a colored line along the direction of travel of the golf ball 19 after impact, an indicator that shows the time and/or point of impact of the head 30 with the golf ball 19, the velocity, the orientation, and the path of travel of the head 30 at the time at or near impact and information regarding areas for the user to correct their swing. The video may be presented in slow motion and/or the user may control the rate and/or progression of the presentation.

The example method 130 includes a capture step 131, a generate step 132, a compare step 133, a transmit step 134 and a present step 135. The capture step 131 is the same as the capture step 121. The processing circuit 52 of the motion capture system (e.g., 50, 70) stores the captured data for later processing and calculations.

The generate step 132 is the same as the generate step 124, except that the processing circuit 52 of the motion capture system (e.g., 50, 70), as opposed to the server 110, performs the step. The processing circuit 52 has the computing and/or memory capacity required to perform the computations and/or to store the results.

The compare step 133 is the same as the compare step 125, except that the processing circuit 52 of the motion capture system (e.g., 50, 70), as opposed to the server 110, performs the step. The processing circuit 52 has the computing and/or memory capacity required to perform the comparison and/or to store the results. The processing circuit 52 may store and/or have access to information regarding the desired swing motion of the golf club 20.

In the transmit step 134, the processing circuit 52 transmits the data for display to the smart phone 114. The data transmitted may include the captured data, corrected data, the calculated data (e.g., velocity, orientation, path), the time at or near impact, information regarding the desired swing motion, and any other information for presentation. In an example embodiment, the processing circuit 52 provides and/or generates all information needed for presentation, so that the smart phone 114 need only present without performing any calculations.

The present step 135 is the same as the present step 126, except that the smart phone 114, as opposed to the server 110, performs the step. As with the server 110, the user may control the rate and/or progression of the presentation on the smart phone 114. The smart phone 114 may be mobile, so that the user may view the presentation while practicing to be able to iteratively practice swings while nearly immediately viewing the data collected during each swing.

Any and all headings are for convenience only and have no limiting effect. Unless otherwise defined, all technical and scientific terms used herein have the same meaning as commonly understood by one of ordinary skill in the art to which this invention belongs. Although specific terms are employed herein, they are used in a generic and descriptive sense only and not for purposes of limitation. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls.

The data structures and code described in this detailed description are typically stored on a computer readable storage medium, which may be any device or medium that can store code and/or data for use by a computer system. This includes, but is not limited to, magnetic and optical storage devices such as disk drives, magnetic tape, CDs (compact discs), DVDs (digital video discs), and computer instruction signals embodied in a transmission medium (with or without a carrier wave upon which the signals are modulated). For example, the transmission medium may include a telecommunications network, such as the Internet.

It will be understood that one or more blocks of the block diagrams and flow diagrams, and combinations of blocks in the block diagrams and flow diagrams, respectively, can be implemented by computer-executable program instructions. Likewise, some blocks of the block diagrams and flow diagrams may not necessarily need to be performed in the order presented, or may not necessarily need to be performed at all, according to some embodiments of the invention. These computer-executable program instructions may be loaded onto a general-purpose computer, a special-purpose computer, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the invention may provide for a computer program product, comprising a computer usable medium having a computer-readable program code or program instructions embodied therein, the computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks. Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, can be implemented by special-purpose, hardware-based computer systems that perform the specified functions, elements or steps, or combinations of special-purpose hardware and computer instructions.

The present invention may be embodied in other specific forms without departing from the spirit or essential attributes thereof, and it is therefore desired that the present embodiment be considered in all respects as illustrative and not restrictive. Many modifications and other embodiments of the present disclosure will come to mind to one skilled in the art to which this invention pertains and having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although methods and materials similar to or equivalent to those described herein can be used in the practice or testing of the embodiments in the present disclosure, suitable methods and materials are described above. Thus, the present disclosure is not intended to be limited to the embodiments shown, but is to be accorded the widest scope consistent with the principles and features disclosed herein.

What is claimed is:

1. A golf club for collecting data for a golf swing analyzer system, the golf club comprising:

a head, the head includes a face;

a hosel connected to the head;

a shaft connected to the hosel; and a first inertial measurement unit (IMU) having an x-axis, a y-axis and a z-axis, wherein the first IMU is positioned in the head, wherein the first IMU is oriented to position the x-axis of the first IMU parallel to a central axis of the hosel and the y-axis of the first IMU perpendicular to the face, wherein during a swing of the golf club, the first IMU is configured to capture a first acceleration data along at least the y-axis of the first IMU, a first rotation data around at least the x-axis of the first IMU, and a time at or near an impact of the head with a golf ball;

wherein the first IMU additionally captures magnetic field data, wherein, at or near the impact of the head with the golf ball, the first IMU detects a maximum magnetic field strength, wherein the maximum magnetic field strength corresponds to the time at or near the impact of the head with the golf ball.

2. The golf club of claim 1, further comprising a processing circuit, wherein the processing circuit uses the first acceleration data, the first rotation data and the magnetic field data to determine a velocity of the head and an orientation of the face at the time at or near the impact.

3. The golf club of claim 2, wherein the processing circuit uses the first acceleration data, the first rotation data and the magnetic field data to further determine a path of travel of the head at the time at or near the impact.

4. The golf club of claim 1, further comprising a communication circuit, wherein the communication circuit transmits the first acceleration data, the first rotation data and the magnetic field data to a server or a computing device of the golf swing analyzer system.

5. The golf club of claim 1, further comprising a second IMU having an x-axis, a y-axis and a z-axis, wherein the second IMU is positioned in the head, wherein the second IMU is oriented to position the y-axis of the second IMU parallel to the central axis of the hosel and the x-axis of the second IMU perpendicular to the face, wherein during the swing of the golf club, the second IMU is configured to capture a second acceleration data along at least the x-axis of the second IMU and a second rotation data around at least the y-axis of the second IMU.

6. The golf club of claim 5, further comprising a processing circuit, wherein the processing circuit uses the first and second acceleration data and the first and second rotation data to determine a corrected acceleration data and a corrected rotation data, wherein the processing circuit uses the corrected acceleration data and the corrected rotation data to determine a velocity of the head and an orientation of the face at the time at or near the impact.

7. The golf club of claim 6, wherein the processing circuit uses the corrected acceleration data and the corrected rotation data to further determine a path of travel of the head at the time at or near the impact.

8. The golf club of claim 5, further comprising a communication circuit, wherein the communication circuit transmits the first and second acceleration data, the first and second rotation data and the magnetic field data to a server or a computing device of the golf swing analyzer system.

9. The golf club of claim 5, further comprising a processing circuit and a communication circuit, wherein the processing circuit uses the first and second acceleration data and the first and second rotation data to determine a corrected acceleration data and a corrected rotation data, wherein the communication circuit transmits the corrected acceleration data, the corrected rotation data and the magnetic field data to a server or a computing device of the golf swing analyzer system.

10. The golf club of claim 1, wherein the orientation of the face at the time at or near the impact relates primarily to the rotation data captured around the x-axis of the first IMU.

11. The golf club of claim 1, wherein the velocity of the head of the golf club at the time at or near the impact relates primarily to the acceleration data captured along the y-axis of the first IMU.

12. A golf swing analyzer system comprising:

a golf club having a head, a hosel connected to the head and a shaft connected to hosel, wherein the head includes a face;

a motion capture system having a processing circuit, a communication circuit, a first inertial measurement unit (IMU) and a magnet, wherein the first IMU has an x-axis, a y-axis and a z-axis, wherein the motion capture system is positioned in the head of the golf club, wherein the first IMU is oriented to position the x-axis of the first IMU parallel to a central axis of the hosel and the y-axis of the first IMU perpendicular to the face, wherein during a swing of the golf club, the processing circuit stores a first acceleration data, a first rotation data and a time at or near an impact of the head with a golf ball as captured by the first IMU, wherein the first acceleration data includes an acceleration data captured along at least the y-axis of the first IMU, wherein the first rotation data includes a rotation data captured around at least the x-axis of the first IMU;

wherein the first IMU additionally captures magnetic field data, wherein the magnet is positioned proximate to the first IMU at or near the impact of the head with the golf ball, wherein, at or near the impact of the head with the golf ball, the first IMU detects a maximum magnetic field strength, wherein the maximum field strength corresponds to the time at or near the impact of the head with the golf ball; and a computing device having a display, wherein the communication circuit transmits the first acceleration data, the first rotation data and the time at or near the impact of the head with the golf ball to the computing device, wherein the computing device is adapted to use the first acceleration data, the first rotation data and the time at or near the impact to determine a velocity of the head and an orientation of the face at the time at or near the impact, wherein the computing device is adapted to present the velocity and the orientation on the display for viewing by a user.

13. The golf swing analyzer system of claim 12, wherein the computing device is adapted to use the first acceleration data, the first rotation data and the magnetic field data to further determine a path of travel of the head at the time at or near the impact, wherein the computing device is adapted to further present the path of travel on the display for viewing by the user.

14. The golf swing analyzer system of claim 12, wherein the orientation of the face at the time at or near the impact relates primarily to the rotation data captured around the x-axis of the first IMU.

15. The golf swing analyzer system of claim 12, wherein the velocity of the head of the golf club at the time at or near the impact relates primarily to the acceleration data captured along the y-axis of the first IMU.

16. The golf swing analyzer system of claim 12, wherein the motion capture system further comprises a second IMU, wherein the second IMU has an x-axis, a y-axis and a z-axis, wherein the second IMU is oriented to position the y-axis of the second IMU parallel to the central axis of the hosel and the x-axis of the second IMU perpendicular to the face, wherein during the swing of the golf club, the processing circuit stores a second acceleration data and a second rotation data using data captured by the second IMU, wherein the second acceleration data includes an acceleration data captured along at least the x-axis of the second IMU, wherein the second rotation data includes a rotation data captured around at least the y-axis of the second IMU.

17. The golf swing analyzer system of claim 16, wherein the orientation of the face at the time at or near the impact relates primarily to the rotation data captured around the x-axis of the first IMU and the rotation data captured around the y-axis of the second IMU.

18. The golf swing analyzer system of claim 16, wherein the velocity of the head of the golf club at the time at or near the impact relates primarily to the acceleration data captured along the y-axis of the first IMU and the acceleration data captured along the x-axis of the second IMU.

19. The golf swing analyzer system of claim 16, wherein the communication circuit further transmits the second acceleration data and the second rotation data to the computing device, wherein the computing device is adapted to use the first and second acceleration data, and the first and second rotation data to determine a corrected acceleration data and a corrected rotation data, wherein the computing device is adapted to use the corrected acceleration data, the corrected rotation data and the magnetic field data to determine a corrected velocity of the head and a corrected orientation of the face at the time at or near the impact, wherein the computing device is adapted to present the corrected velocity and the corrected orientation on the display for viewing by the user.

20. The golf swing analyzer system of claim 12, further comprising a mat having a centerline visible along a length thereof, wherein the head of the golf club further comprises a first LED, a second LED and a sweet spot on the face thereof, wherein the first LED and the second LED are positioned on a top portion of the head along an axis that is perpendicular to the face and in-line with the sweet spot, wherein a first light from the first LED and a second light from the second LED provide a visual cue to the user regarding a path of travel of the head relative to the centerline of the mat.

* * * * *